US007063574B2

(12) United States Patent
Mazzullo et al.

(10) Patent No.: US 7,063,574 B2
(45) Date of Patent: Jun. 20, 2006

(54) INSTALLATION COUPLER

(75) Inventors: Ray Mazzullo, Constantia (ZA); Adrian Mazzullo, Constantia (ZA)

(73) Assignee: Power Logic Holdings AG, Aarau (CH)

( * ) Notice: Subject to any disclaimer, the term of this patent is extended or adjusted under 35 U.S.C. 154(b) by 0 days.

(21) Appl. No.: 11/246,186

(22) Filed: Oct. 11, 2005

(65) Prior Publication Data

US 2006/0079123 A1 Apr. 13, 2006

(30) Foreign Application Priority Data

Oct. 13, 2004 (ZA) ..... 2004/8258

(51) Int. Cl.
*H01R 13/64* (2006.01)

(52) U.S. Cl. ..... 439/677; 439/924.2

(58) Field of Classification Search ..... 439/680, 439/677, 650, 638, 924.2, 633
See application file for complete search history.

(56) References Cited

U.S. PATENT DOCUMENTS

| | | | | |
|---|---|---|---|---|
| 3,264,599 | A | 8/1966 | Kinkaid | |
| 3,399,374 | A * | 8/1968 | Pauza et al. | 439/680 |
| 3,697,927 | A * | 10/1972 | Kunkle et al. | 439/650 |
| 4,399,371 | A | 8/1983 | Ziff et al. | |
| 4,493,517 | A | 1/1985 | Hillary | |
| 4,514,024 | A | 4/1985 | Clark | |
| 4,528,429 | A | 7/1985 | Dobson et al. | |
| 4,704,091 | A | 11/1987 | Owens et al. | |
| 4,775,327 | A | 10/1988 | Normann et al. | |
| 4,796,159 | A | 1/1989 | Miksche | |
| 5,230,636 | A | 7/1993 | Masuda et al. | |
| 5,243,136 | A | 9/1993 | Chen | |
| 5,417,585 | A | 5/1995 | Morin et al. | |
| 5,579,201 | A | 11/1996 | Karageozian | |
| 5,582,180 | A * | 12/1996 | Manset et al. | 439/924.2 |
| 5,751,135 | A | 5/1998 | Fukushima et al. | |
| 6,135,820 | A | 10/2000 | Chiang | |
| 6,179,381 | B1 | 1/2001 | Gevaert | |
| 6,217,353 | B1 | 4/2001 | Yu-Tse | |
| 6,252,169 | B1 | 6/2001 | Gegusch-Brunner et al. | |
| 6,375,515 | B1 | 4/2002 | Higuchi | |
| 6,383,003 | B1 | 5/2002 | Corona | |

(Continued)

FOREIGN PATENT DOCUMENTS

| | | |
|---|---|---|
| DE | 26 35 721 | 2/1978 |

(Continued)

*Primary Examiner*—Tho D. Ta
(74) *Attorney, Agent, or Firm*—Douglas E. Jackson; Stites & Harbison PLLC

(57) ABSTRACT

An installation coupler is disclosed for connecting a first cable (306) to a second cable (330) in and installation for supplying power to at least two workstations (322) via a free set of plug pin socket contacts (314) and via the second cable (330). The first cable (306) has a double female installation socket (300) with two sets of contacts (314) and the second cable (330) has a male installation plug (304) that can be plugged into at least one of the sets of contacts (314), with a predetermined orientation of the plug (304) relative to the set of contacts (314). The installation plug (304) includes a protruding stop (307) that partly obstructs the lower one of the sets of contacts (314) when the plug is incorrectly connected to the upper set, and that is clear of the contacts (314) when the plug (304) is correctly connected to the lower set. The protruding stop (307) thus prevents the simultaneous connection of the plugs (304) of more than one second cable (330), to the double female socket (300).

9 Claims, 18 Drawing Sheets

U.S. PATENT DOCUMENTS

| | | | |
|---|---|---|---|
| 6,410,994 | B1 | 6/2002 | Jones et al. |
| 6,422,884 | B1 | 7/2002 | Babasick et al. |
| 6,425,773 | B1 | 7/2002 | Mosebach et al. |
| 6,486,407 | B1 | 11/2002 | Hawker et al. |
| 6,537,089 | B1 | 3/2003 | Montague |
| 6,573,617 | B1 | 6/2003 | Jones et al. |
| 2001/0024894 | A1 | 9/2001 | Mosebach et al. |
| 2002/0189848 | A1 | 12/2002 | Hawker et al. |
| 2003/0056970 | A1 | 3/2003 | Young |
| 2004/0018775 | A1 | 1/2004 | Mazzullo et al. |

FOREIGN PATENT DOCUMENTS

| | | |
|---|---|---|
| EP | 0 161 456 | 11/1985 |
| EP | 0 321 810 | 6/1989 |
| EP | 0 512 208 | 11/1992 |
| FR | 2 699 745 | 6/1994 |
| GB | 2 105 924 | 3/1983 |

* cited by examiner

INSTALLATION COUPLER

FIELD OF THE INVENTION

THIS INVENTION relates to installation couplers.

BACKGROUND TO THE INVENTION

In the specification of South African Patent Application No. 2003/4660 there is disclosed an installation coupler for use in an office environment.

In such environments, where computer networks comprising many individual computers are found, the need arises to supply each computer with power. This is achieved inter alia by the use of installation couplers which link the power supply leads of the individual computers to the mains supply. Such couplers are not intended to be disengaged under load and remain permanently connected, except during reconfiguration of the network. An installation coupler comprises an installation plug which includes plug pins and an installation socket which includes socket contacts for receiving the plug pins.

It is not only computer networks which, in an office environment, need to be supplied with power. Other equipment such as scanners and printers also need to be connected to the mains supply.

The present invention seeks to provide a novel and advantageous installation coupler and a novel and advantageous installation for supplying power which coupler and installation are improvements to the coupler and installation of the above identified patent specification.

BRIEF DESCRIPTION OF THE INVENTION

According to one aspect of the present invention there is provided an installation coupler for connecting a first cable to a second cable while providing a free set of plug pin socket contacts, said first cable having a double female installation socket attached thereto and said second cable having a male installation plug attached thereto, said male installation plug comprising a set of male plug pins which include means for enabling the cores of said second cable to be attached thereto and said double female installation socket comprising first and second sets of plug pin socket contacts said sets of contacts being connected to one another, there being means for attaching the cores of said first cable to the two sets of contacts, said pins of the male installation plug and corresponding contacts in each of said sets of contacts in the double female installation plug having a configuration that allows the pins to be in register with the contacts of one of the sets of contacts, only when the male installation plug as a predetermined orientation relative to the set of contacts, wherein the male installation plug includes a protruding stop that at least partly obstructs the first set of contacts when the male installation plug is connected to the second set of contacts and that is clear of the second set of contacts when the male installation plug is connected to the first set of contacts.

The invention extends to an installation for supplying power to at least two electrical devices such as workstations, said installation including a main plug for connecting the installation to a source of electrical power, a double female installation socket, and a first cable connecting said main plug to said double female installation socket, the double female installation socket comprising first and second sets of plug pin socket contacts, said set of contacts being connected to one another and there being means for attaching the cores of said first cable to said two sets of contacts, said installation further including a second cable having a male installation plug attached thereto, said male installation plug comprising a set of male plug pins which include means for enabling the cores of said second cable to be attached thereto, said pins of the male installation plug and corresponding contacts in each of said sets of contacts in the double female installation plug having a configuration that allows the pins to be in register with the contacts of one of the sets of contacts, only when the male installation plug as a predetermined orientation relative to the set of contacts, wherein the male installation plug includes a protruding stop that at least partly obstructs the first set of contacts when the male installation plug is connected to the second set of contacts and that is clear of the second set of contacts when the male installation plug is connected to the first set of contacts, the second set of contacts being connectable to a first electrical device and the second cable being connectable to at least one further electrical device.

In the preferred form said male installation plug includes an elongate casing having a bore at one end through which the second cable enters the installation plug, said plug pins being at the other end of the casing of the male installation plug, said stop of said male installation plug being a flange which protrudes outwardly from said casing, adjacent said other end.

Said double female installation socket may include a casing and said contacts may be in said casing, the two sets of contacts being disposed in a parallel configuration.

A plug pin entrance may be defined in the casing in line with each contact and the female installation socket may include a shutter within the casing, said shutter being displaceable between an operative position in which it extends, at least in part, across at least some of said entrances, and an inoperative position in which openings in the shutter and openings in walling of the casing are in register for permitting the male plug pins of said male installation plug to pass through said openings and enter the socket contacts, said opening in the shutter being partially aligned with one of the openings in the walling when in the operative position, whereby an entering male plug pin may displace the shutter to its inoperative position so that a set of male plug pins may enter the socket contacts.

A second double female installation socket may be connected to the end of the second cable that is remote from the male installation plug.

BRIEF DESCRIPTION OF THE DRAWINGS

For a better understanding of the present invention, and to show how the same may be carried into effect, reference will now be made, by way of example, to the accompanying drawings in which:—

DETAILED DESCRIPTION OF THE DRAWINGS

Figure 1:
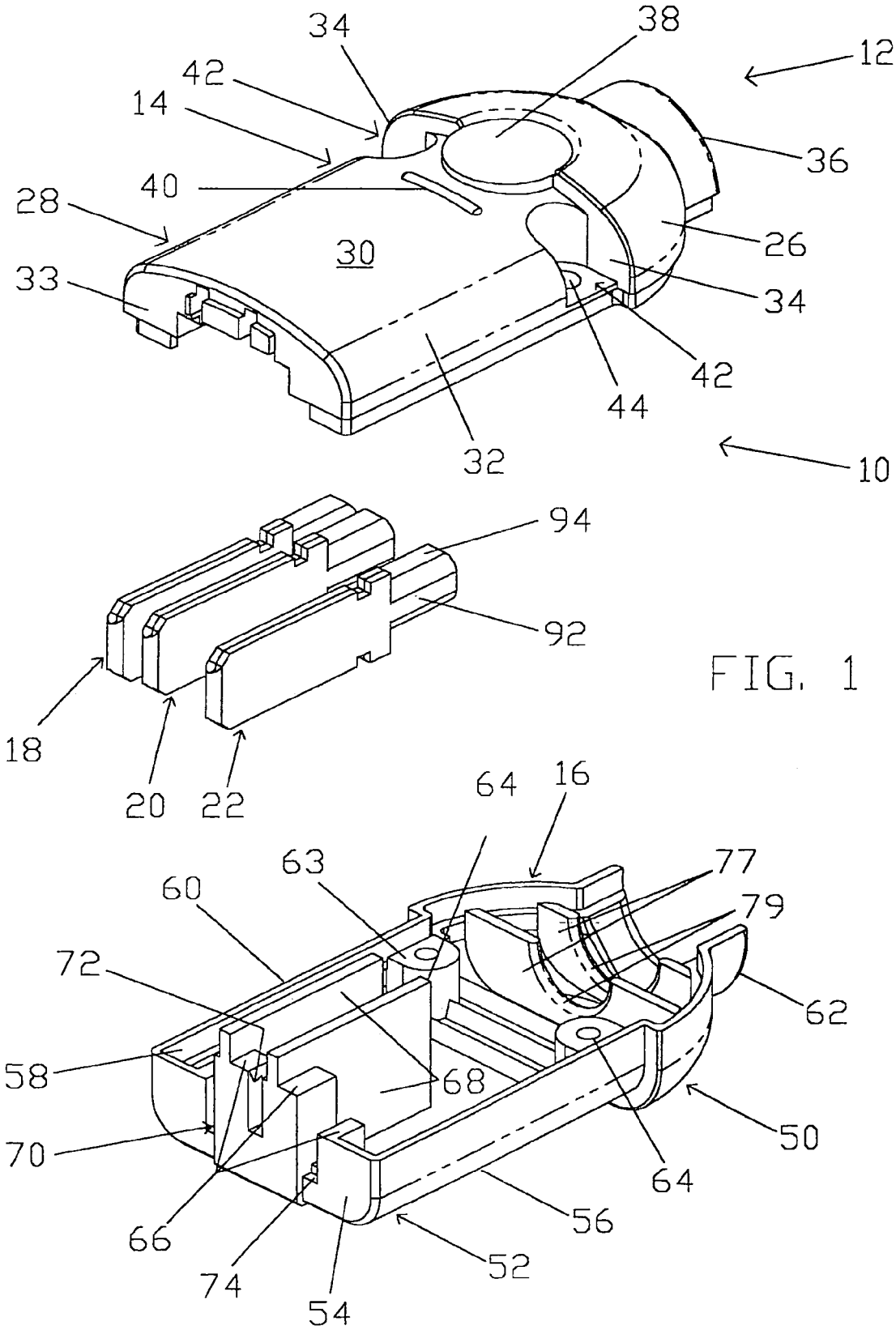
FIG. 1 is an exploded view of the components comprising an installation plug of an installation coupler in accordance with the present invention.
Figure 2:
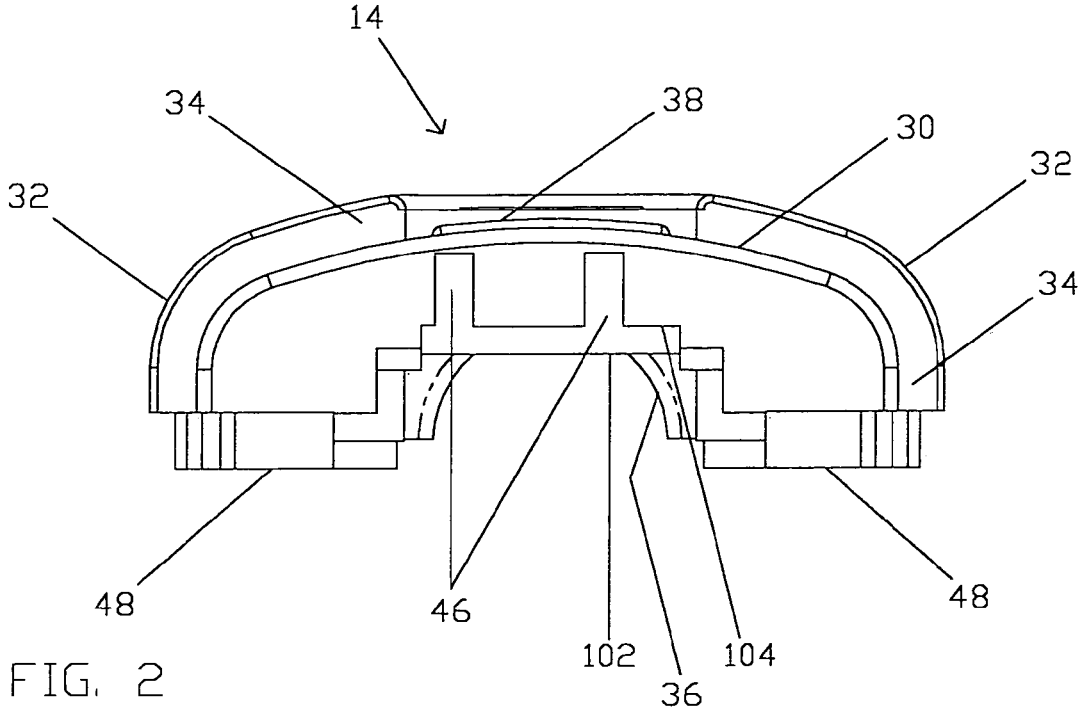
FIG. 2 is a front view of an upper casing part of the installation plug.

Referring firstly to FIGS. 1 to 11, reference numeral 10 generally designates an installation plug forming one part of an installation coupler. The plug 10 comprises a casing 12, three electrical plug pins 18, 20 and 22 and a sleeve 24 (see FIG. 8). The casing 12 and sleeve 24 are manufactured from a non-conductive material, the material preferably being a moulded plastics material. The casing 12 comprises two inter-connectable sections, namely, an upper casing part 14 and a lower casing part 16.

The upper casing part 14 comprises a rear section 26 and an integrally moulded front section 28. The front section 28 is essentially rectangular in shape when viewed in plan with a slightly convex top surface 30, rounded side walls 32 and a front wall 33. The rear section 26 is generally hemispherical in shape and is integrally moulded with the front section 28. Furthermore, the rear section 26 is stepped with respect to the front section 28 thereby to provide two shoulders 34.

A semi-cylindrical portion 36 extends rearwardly from the rear section 26. A circular protrusion 38 and a rectangular protrusion 40 are provided on the upper casing part 14. Recesses 42 are provided on each side of the upper part 14 adjacent the shoulders 34. Holes 44 located in the recesses 42 serve to receive screws (not shown) which connect the upper part 14 and the lower part 16.

Two longitudinally extending grooves 46 (see particularly FIG. 3) are provided in the inside face of the front section 28. An edge of the part 14 is stepped to provide a rim 48 which extends substantially around the perimeter of the upper part 14.

Figure 3:
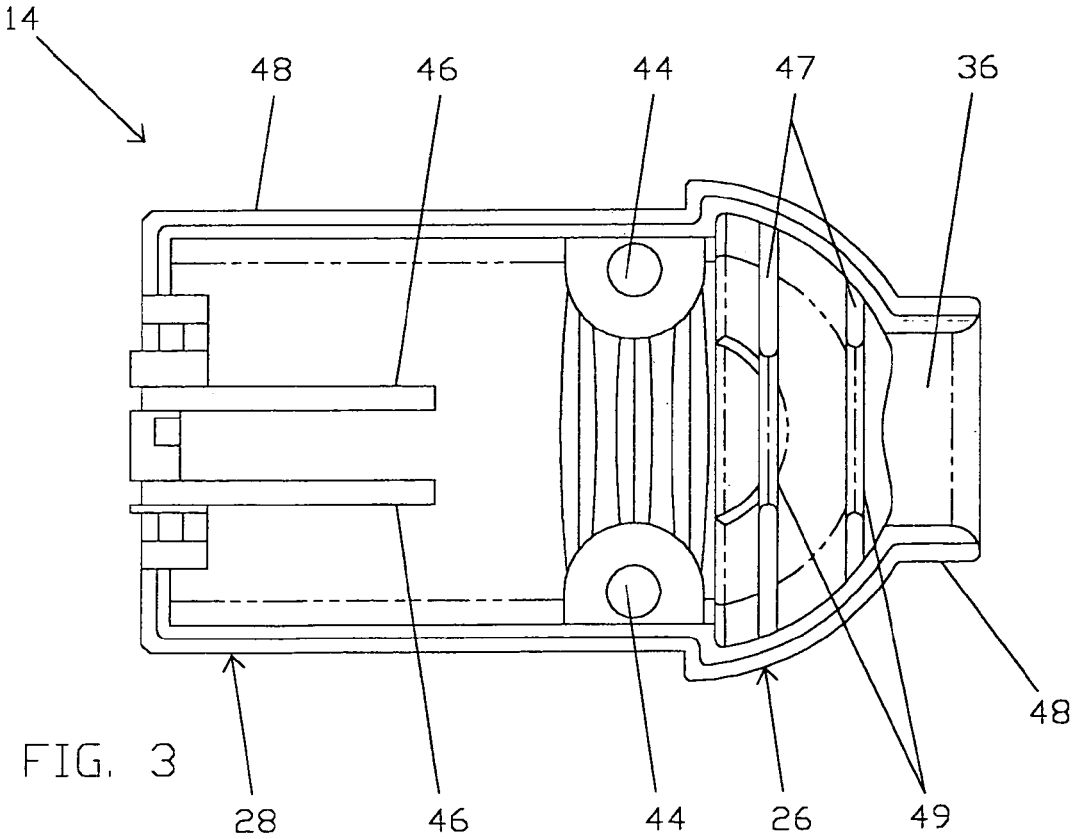
FIG. 3 is an underneath plan view of the upper casing part of FIG. 2.
Figure 4:
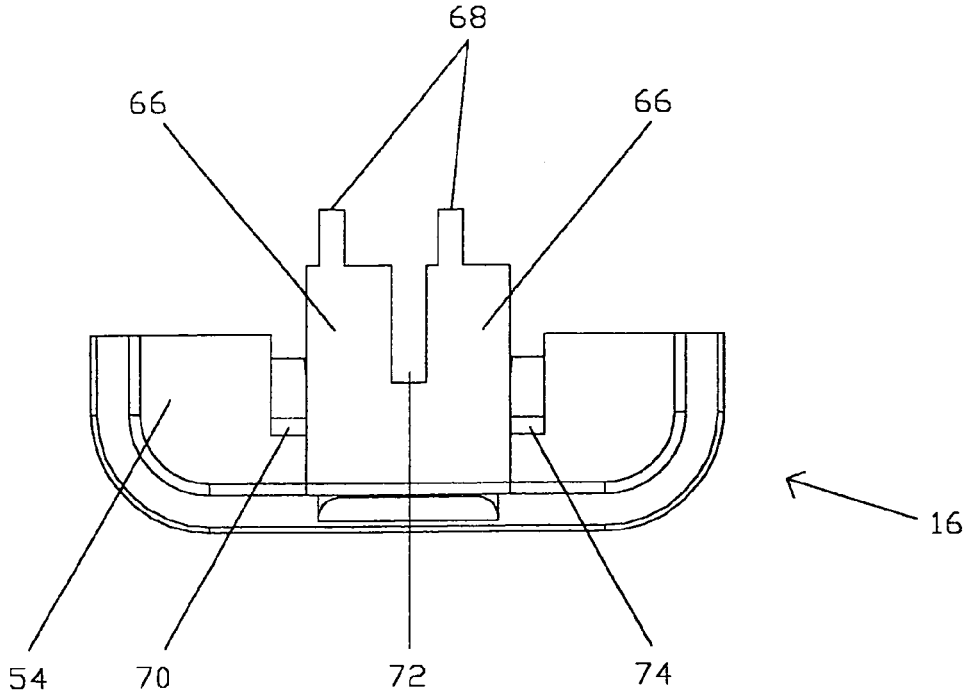
FIG. 4 is a front view of the lower casing part of the installation plug.
Figure 5:
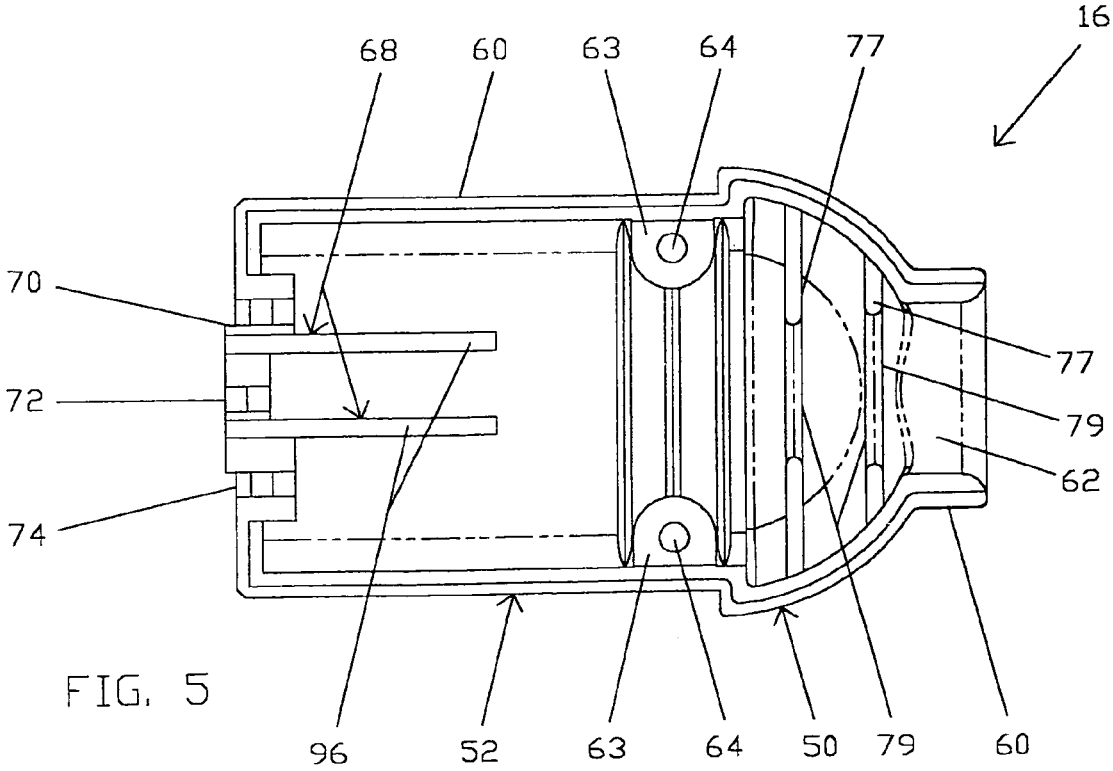
FIG. 5 is a top plan view of the lower casing part of FIG. 4.
Figure 6:
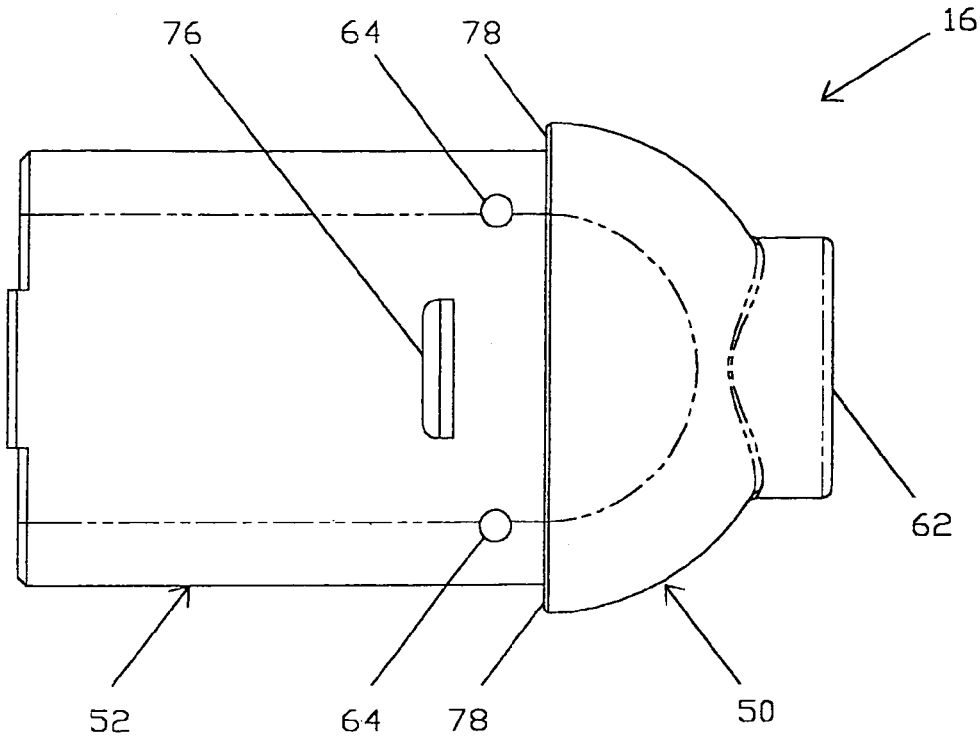
FIG. 6 is an underneath plan view of the casing part of FIG. 4.

Referring to FIG. 3, transverse ribs 47 are provided on the underside of the upper body 14. The ribs 47 are each formed with a semi-circular recess 49.

The lower casing part 16 (see FIGS. 1, 4, 5 and 6) comprises a rear section 50 and an integrally moulded front section 52. The rear section 50 and front section 52 are substantially identical in shape to the sections 26 and 28 respectively. The front section 52 comprises an upstanding front wall 54 and upstanding side walls 56 and 58 (FIG. 1). The front wall 54 and side walls 56 and 58 are stepped to provide a rim 60 which extends substantially around the perimeter of the lower body 16. The rims 48, 60 snap fit together as the casing 12 is assembled.

A semi-cylindrical portion 62 extends rearwardly from the rear section 50 and is substantially identical in shape to the portion 36. On assembly of the upper casing part 14 to the lower casing part 16, the portions 36 and 62 cooperate to form a cylindrical bore for receiving an electrical cable (not shown).

Holes 64 are provided in bosses 63 located on each side of the lower part 16 at the region where the rear section 50 and front section 52 join. On assembly of the casing 12, the holes 64 cooperate with the holes 44 to allow screws (not shown), or other suitable attachment means, to be inserted into the holes 44 and 64, thereby securing the upper casing part 14 to the lower casing part 16.

Walls 66 and separators 68 are moulded integrally with the front wall 54 of the front section 52 to provide recesses 70, 72, 74 for the pins 18, 20, 22.

A rectangular protrusion 76 (see FIG. 6) Is provided on the outside of the lower casing part 16. The rear section 50 is stepped with respect to the front section 52 to provide shoulders 78.

Ribs 77 (see FIGS. 1 and 5) are provided in the lower casing part 16. The ribs 77 have semi-circular recesses 79 which cooperate with the recesses 49 in the upper casing part 14 to grip the electrical cable.

Figure 7:
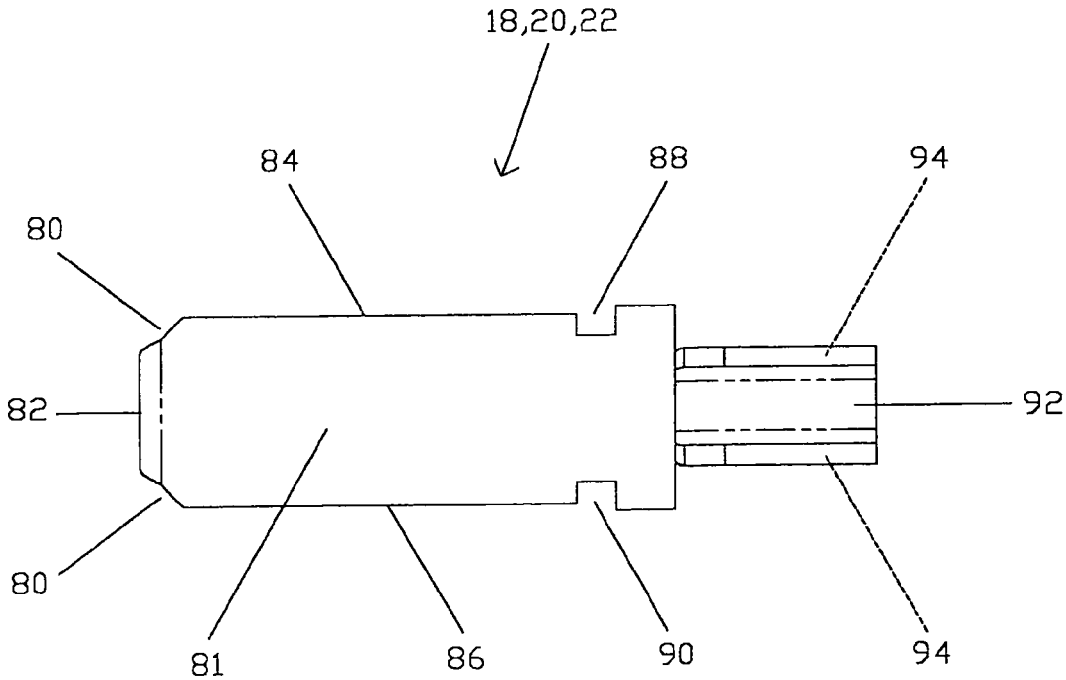
FIG. 7 is a side view of one of the plug pins shown in FIG. 1.

Referring to FIG. 7, the plug pins 18, 20, 22 each comprise a main portion 81 and an elongate portion 92. Both the main portion 81 and the elongate portion 92 are substantially rectangular in shape and are manufactured from brass, or other suitable electrically conductive material. Chamfers 80 are provided between the front edge 82 and the side edges 84 and 86 of the main portion 81. The chamfers 80 assist the pins 18, 20, 22 in cooperating with a shutter, as will be described in more detail hereafter.

Recesses 88 and 90 are provided in the edges 84 and 86 respectively and assist in locating the pins 18, 20, 22 with respect to the upper and lower casing parts 14 and 16.

The elongate portion 92 is formed by bending the material through right-angles to form two side walls 94. The side walls 94 are perpendicular to the remainder of the elongate portion 92 and form a channel-like configuration which can best be seen in FIG. 1.

On assembly, the pins 18, 20, 22 are inserted into the recesses 70, 72, 74 in the lower casing part 16 such that the front wall 54 of the lower casing part 16 is located within the recesses 90 of the pins 18, 20, 22. The main portions 81 thus protrude outwardly from the front wall 54. The centre earth pin 20 protrudes slightly further than the neutral and live pins 18, 22. The elongate portions 92 of the pins 18, 20, 22 are located in the cavity formed by the front wall 54 and the side walls 56 and 58.

To assemble the casing 12, the upper casing part 14 is placed on the lower casing part 16 such that the rim 48 snap fits inside the rim 60 of the lower casing part 14. The separators 68 fit into the grooves 46 provided on the inside face of the upper casing part 14. The top surfaces of the walls 66 bear on the front wall 33 of the upper casing part 14.

Screws (not shown), or other suitable attachment means, are then inserted through the holes 44 and 64 to secure the casing parts 14, 16 together.

Referring now to FIGS. 8 to 11, the sleeve 24 is essentially rectangular in cross-section and comprises a rounded top surface 106, a flat bottom surface 108 and side walls 110 and 112. The sleeve 24 is open at each end so that the top surface 106, the bottom surface 108 and side walls 110 and 112 bound a hollow cavity 114 for receiving the casing 12.

Three shallow grooves 116 extend longitudinally from the front edge 118 of the top surface 106. A semi-circular cut-out 120 is provided in the rear edge 122 of the top surface 106. The cut-out 120 is centrally located along the sleeve's longitudinal axis and cooperates with the circular protrusion 38 on the upper casing part 14 on assembly.

A rectangular recess 105 is provided on the underside of the top surface 106 and receives the protrusion 40 of the upper casing part 14. A rectangular opening 124 (see FIG. 11) is provided in the bottom surface 108 which receives the rectangular protrusion 76 provided on the underside of the lower casing part 16.

An opening 126 (see FIG. 11) is provided in the side wall 112, the opening 126 being bounded by a straight edge and a generally semi-circular edge.

Figure 8:
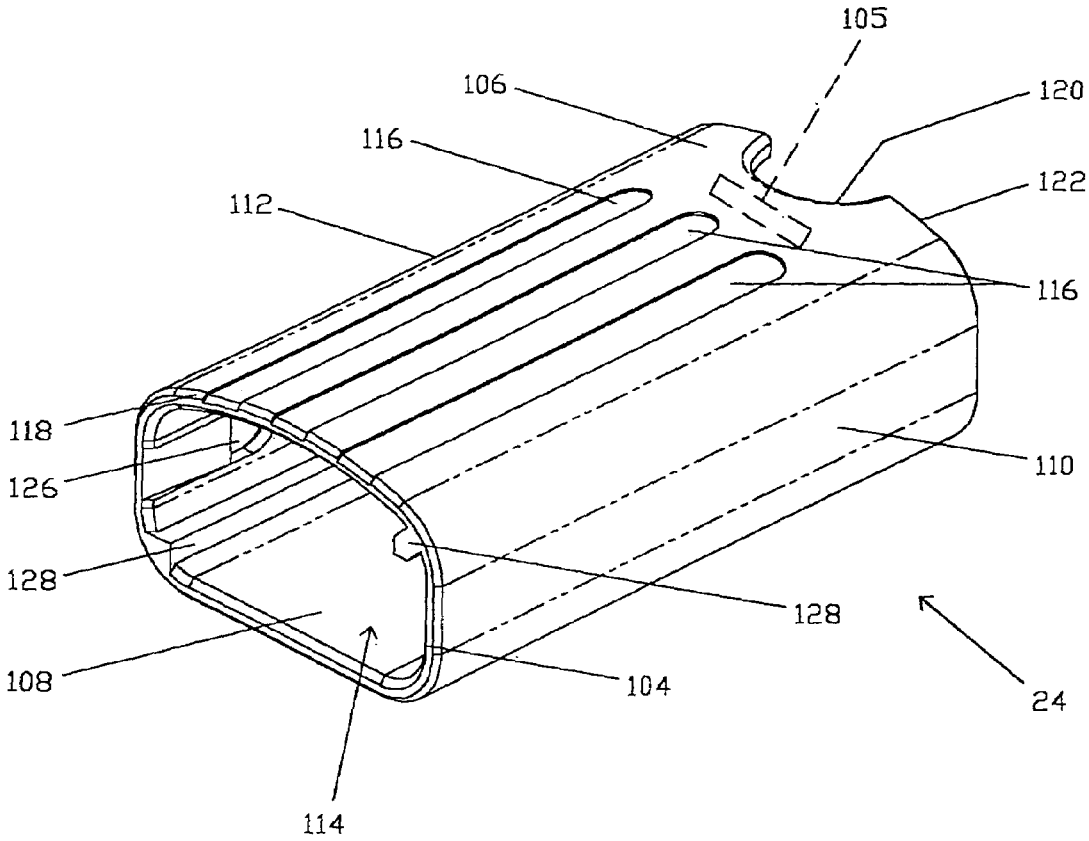
FIG. 8 is a diagrammatic representation of a sleeve forming part of the installation plug of FIG. 1.
Figure 9:
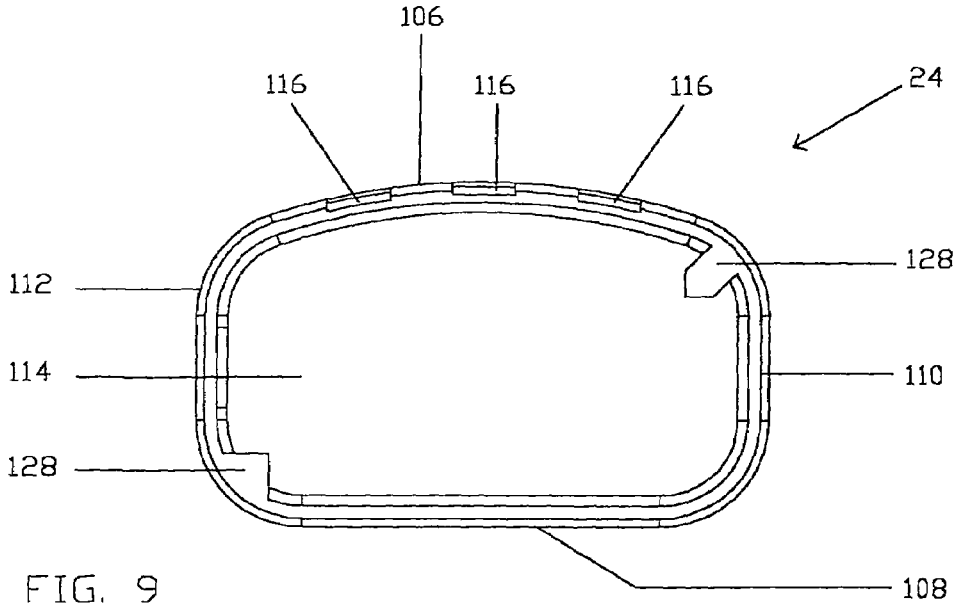
FIG. 9 is a front view of the sleeve of FIG. 8.
Figure 10:
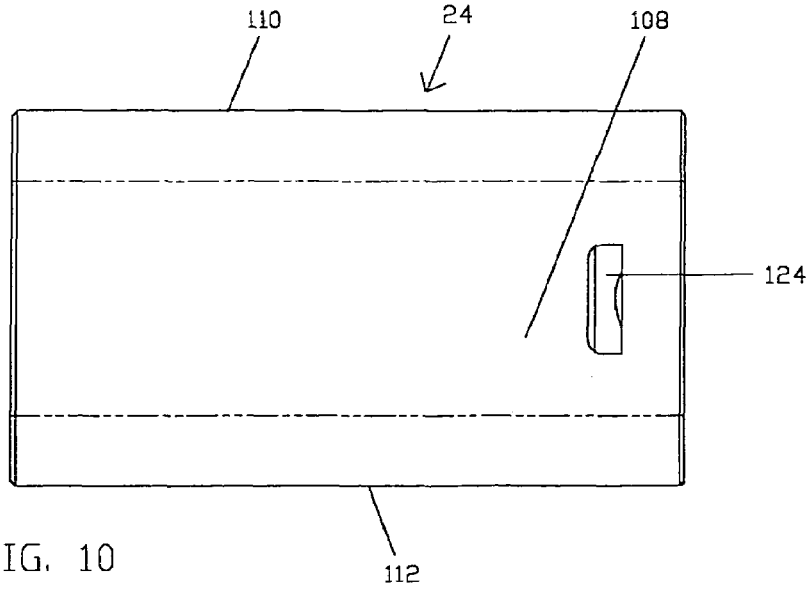
FIG. 10 is an underneath plan view of the sleeve of FIG. 8.
Figure 11:
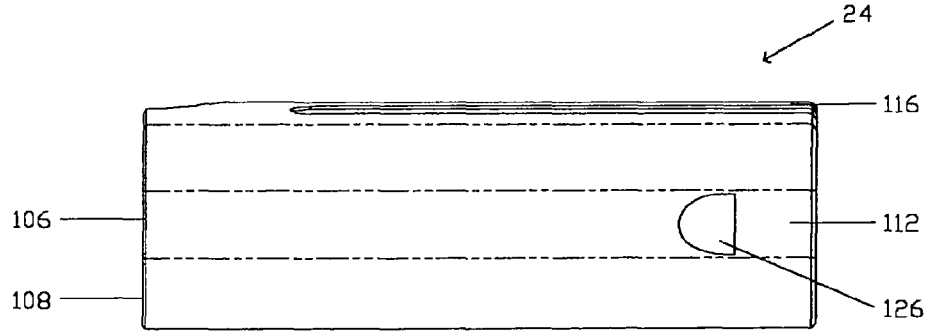
FIG. 11 is a side view of the sleeve of FIG. 8.

Two longitudinally extending ribs 128 are provided in the upper right-hand corner and the lower left-hand corner of the cavity 114, as viewed in FIG. 8, and extend from the front edge 118 of the sleeve 24 to substantially mid-way along the length of the sleeve 24. The ends of the ribs 128 remote from the front edge 118 serve as stops.

Figure 12:
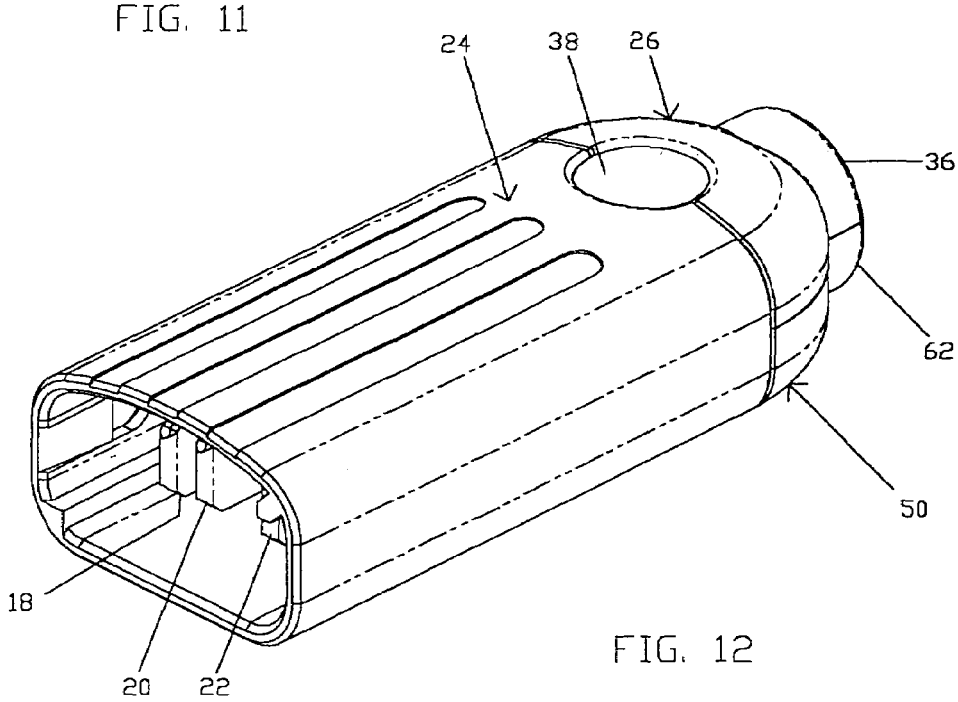
FIG. 12 is a pictorial view of an assembled installation plug.

The assembly of the installation plug 10 is completed by inserting the casing 12 into the cavity 114 of the sleeve 24 (see FIG. 12) such that the circular protrusion 38 cooperates with the cut-out 120 and such that the rear edge 122 of the sleeve 24 abuts the shoulders 34 and 78. The rectangular protrusion 40 located on the top surface 30 of the upper casing part 14 enters the recess 105 in the underside of the top surface 106 of the sleeve 24. Furthermore, the rectangular protrusion 76 located on the underside of the lower casing part 16 enters the opening 124 provided in the bottom surface 108 of the sleeve 24. These various interlocks secure the sleeve 24 to the casing 12.

In FIGS. 13 to 21, reference numeral 130 generally designates an installation socket. The installation socket 130 comprises a casing 132, three electrical socket contacts 134, 136 and 138, a flexible shutter 140 and a sleeve 142 (see FIG. 21). The casing 132 and sleeve 142 are manufactured from a non-conductive material, the material preferably being a moulded plastic material. The casing 132 comprises two inter-connectable sections, referred to hereinafter as an upper casing part 144 and a lower casing part 146.

Figure 13:
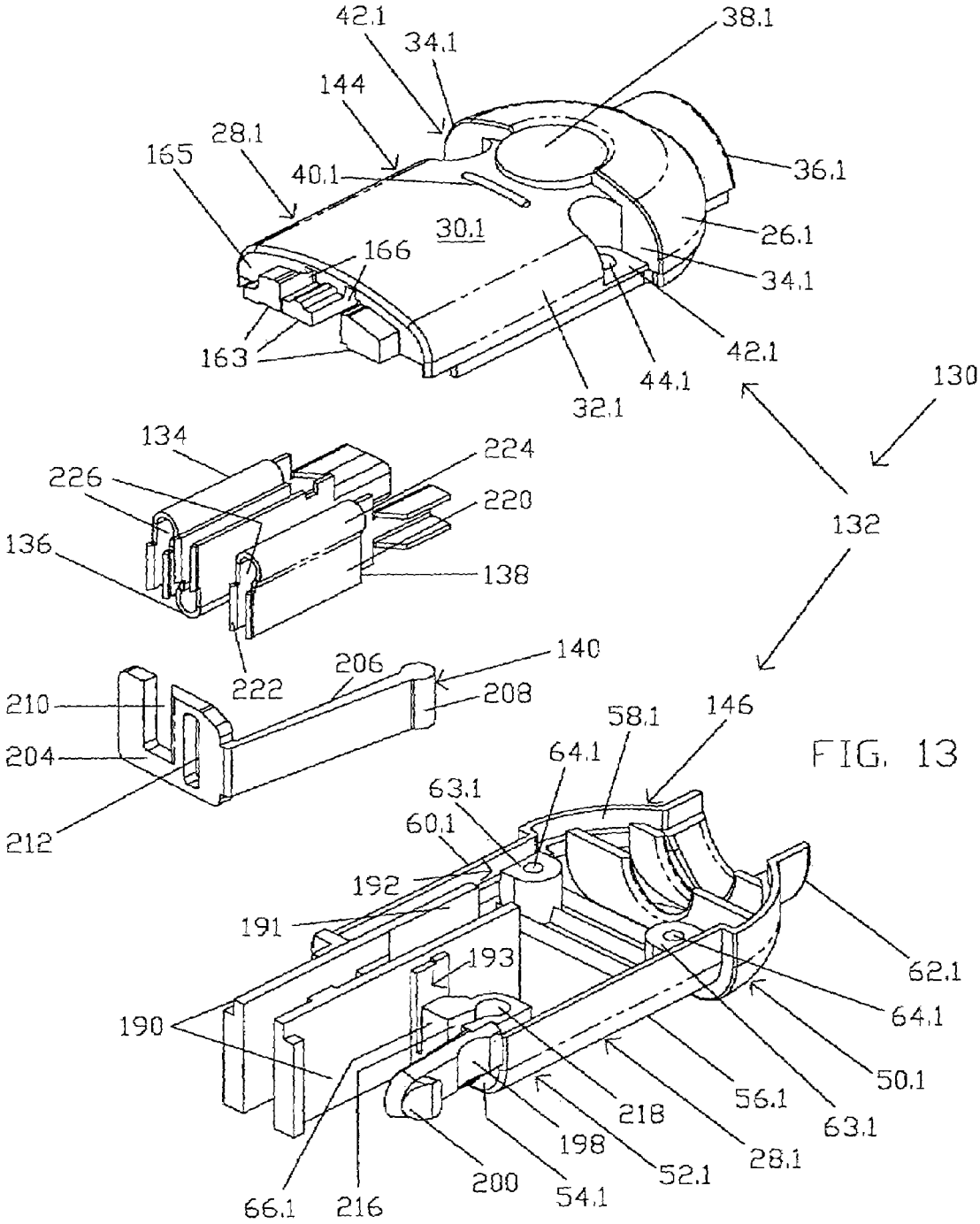
FIG. 13 is an exploded view of components comprising an installation socket of an installation coupler in accordance with the present invention.
Figure 14:
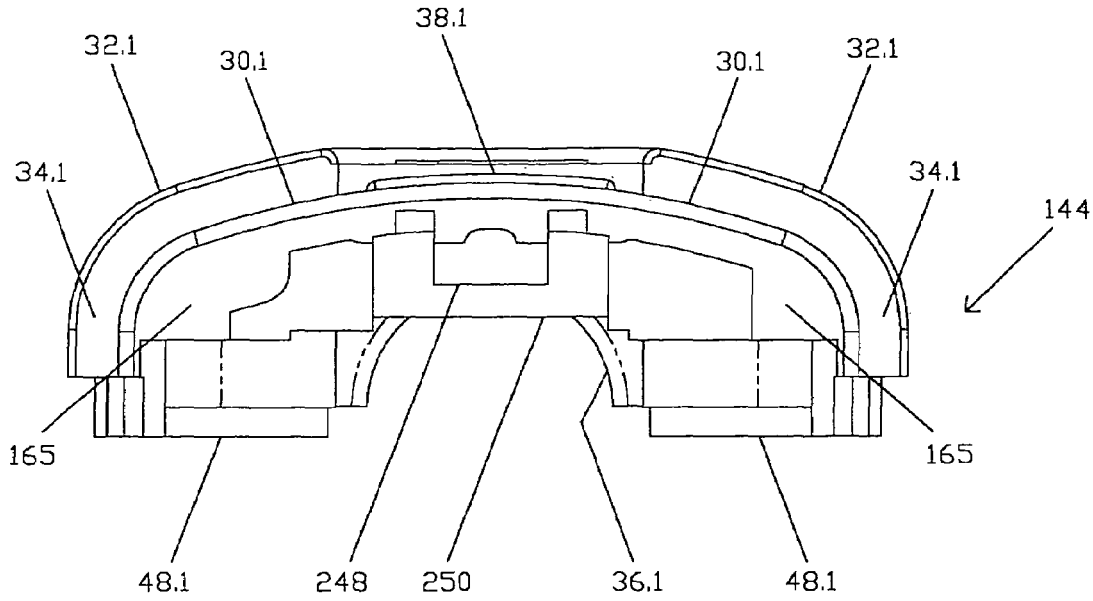
FIG. 14 is a front view of the upper casing part of FIG. 13.
Figure 15:
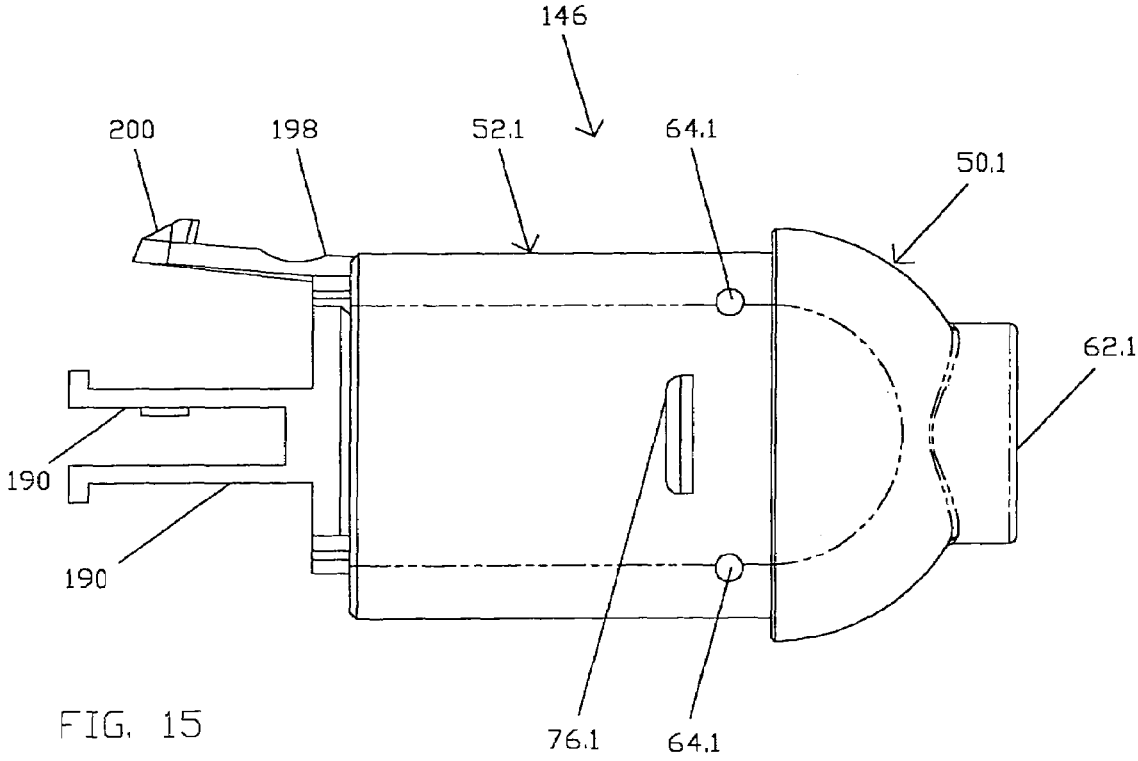
FIG. 15 is an underneath plan view of the lower casing part of FIG. 13.

The installation socket 130 has many features in common with the installation plug 10 described above. These features will not be described again. In FIGS. 13 etc they have been designated with the same reference numerals as have been used herein above with the addition of the suffix ".1". Only those features which differentiate the installation socket 130 from the installation plug 10 will be described in detail.

An elongate protrusion 198 (see particularly FIG. 13) is integrally moulded to the front section 28.1 of the lower casing part 146. The protrusion 198 has a barbed portion 200 at the end of the protrusion 198 remote from the front section 28.1. The protrusion 198 is configured so that it can bend slightly.

The flexible shutter 140 comprises a vertical front wall 204 and an elongate flexible vertical side wall 206. The front wall 204 and side wall 206 are substantially at right angles to one another and are joined at the right-hand edge of the front wall 204, as viewed in FIG. 13. A cylindrical boss 208 is provided at the end of the side wall 206 remote from the front wall 204.

In a further embodiment the shutter is in two parts, the front wall and the side wall being moulded as separate components. The front portion of one side face of the wall 206 bears oh the right hand end of the shutter 204 as illustrated in FIG. 13.

Two slots 210 and 212 are provided in the front wall 204. The slot 210 is bounded on three sides and open at is upper end (as viewed in FIG. 13), while the slot 212 is closed on all four sides. One vertical edge of the slot 210 is chamfered.

A rectangular channel 216 extends rearwardly from the front wall 54.1 and merges with a cylindrical recess 218. The shutter 140 is assembled to the lower body 146 by inserting the cylindrical boss 208 into the correspondingly shaped recess 218 such that the side wall 206 is within the rectangular channel 216.

There is a slot 191 between a pair of spacers 190 and slots 192, 193 outwardly of the spacers 190.

Figure 16:
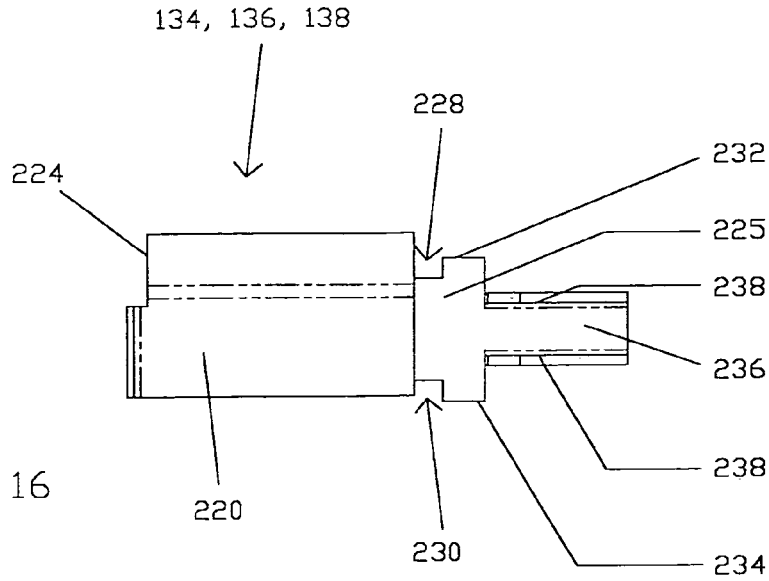
FIG. 16 is a side view of one of the socket contacts of the installation socket of FIG. 13.
Figure 17:
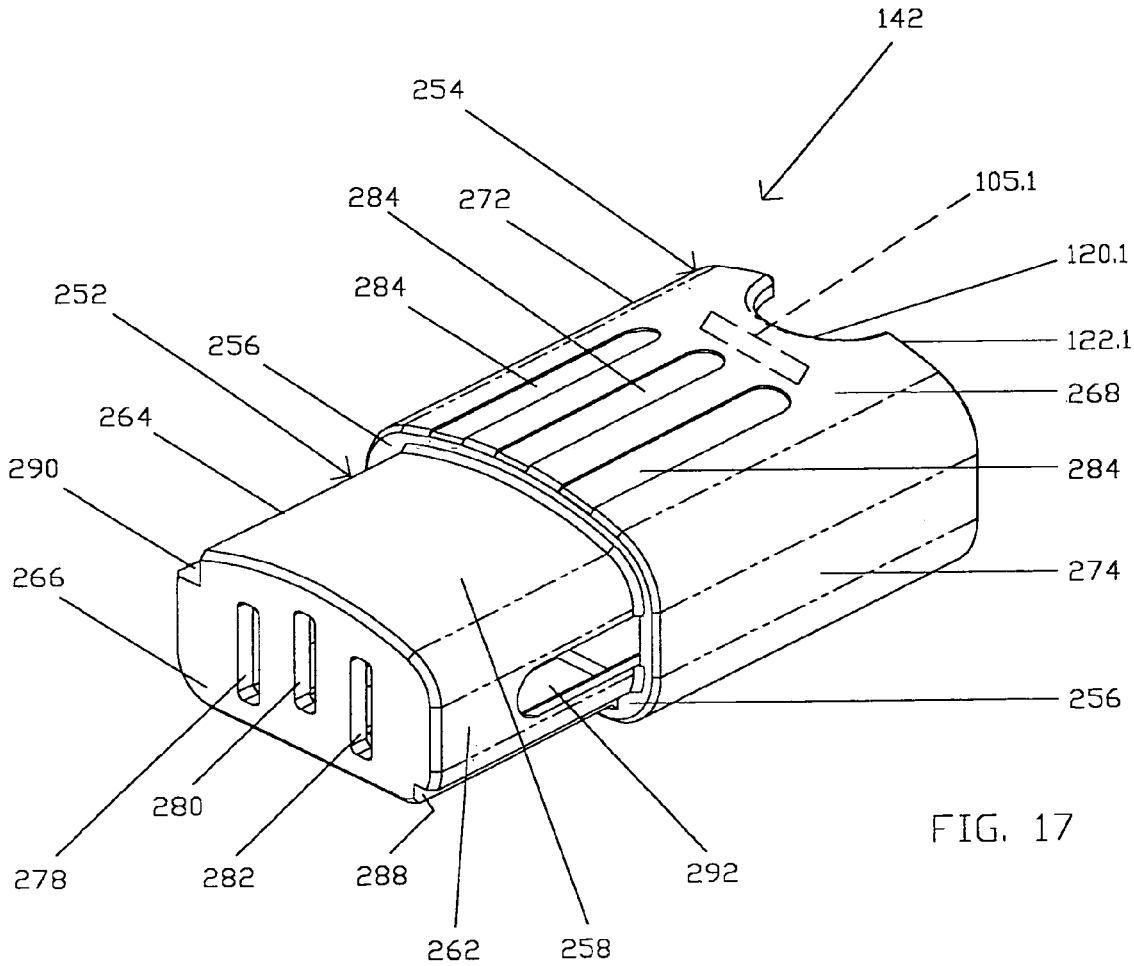
FIG. 17 is a pictorial view of a sleeve of the installation socket of FIG. 13.
Figure 18:
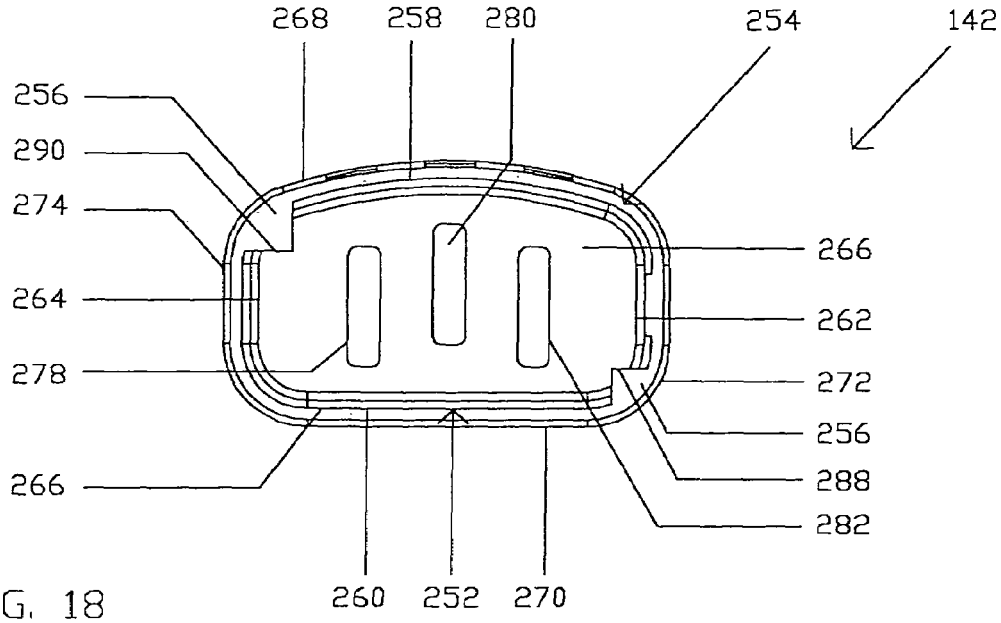
FIG. 18 is a front view of the sleeve of FIG. 17.
Figure 19:
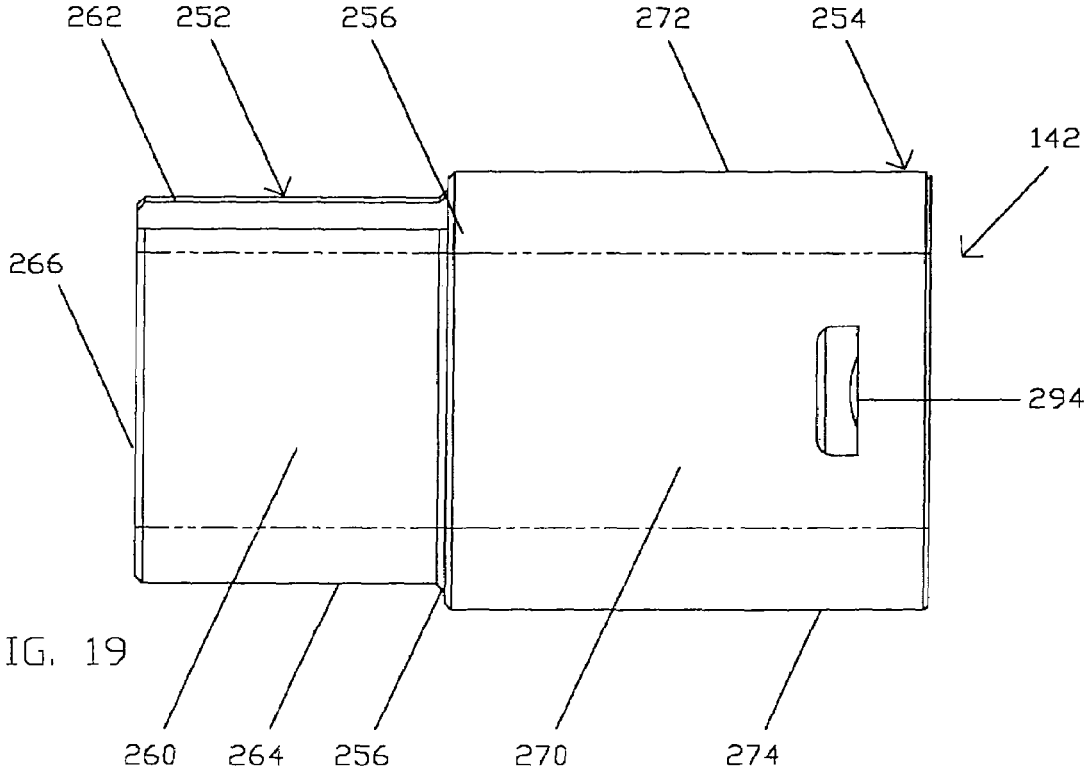
FIG. 19 is an underneath plan view of the sleeve of FIG. 17.
Figure 20:
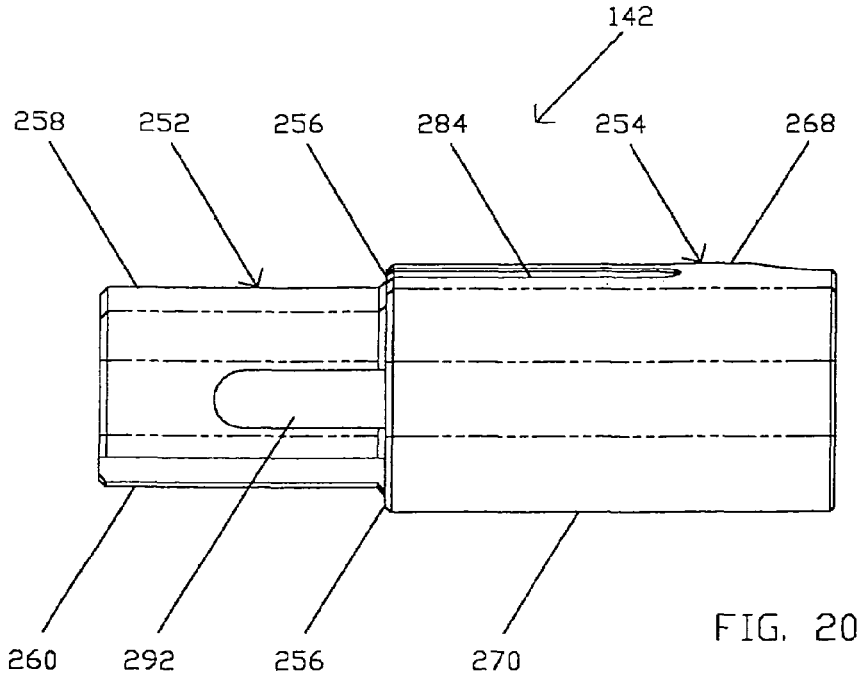
FIG. 20 is a side view of the sleeve of FIG. 17.
Figure 21:
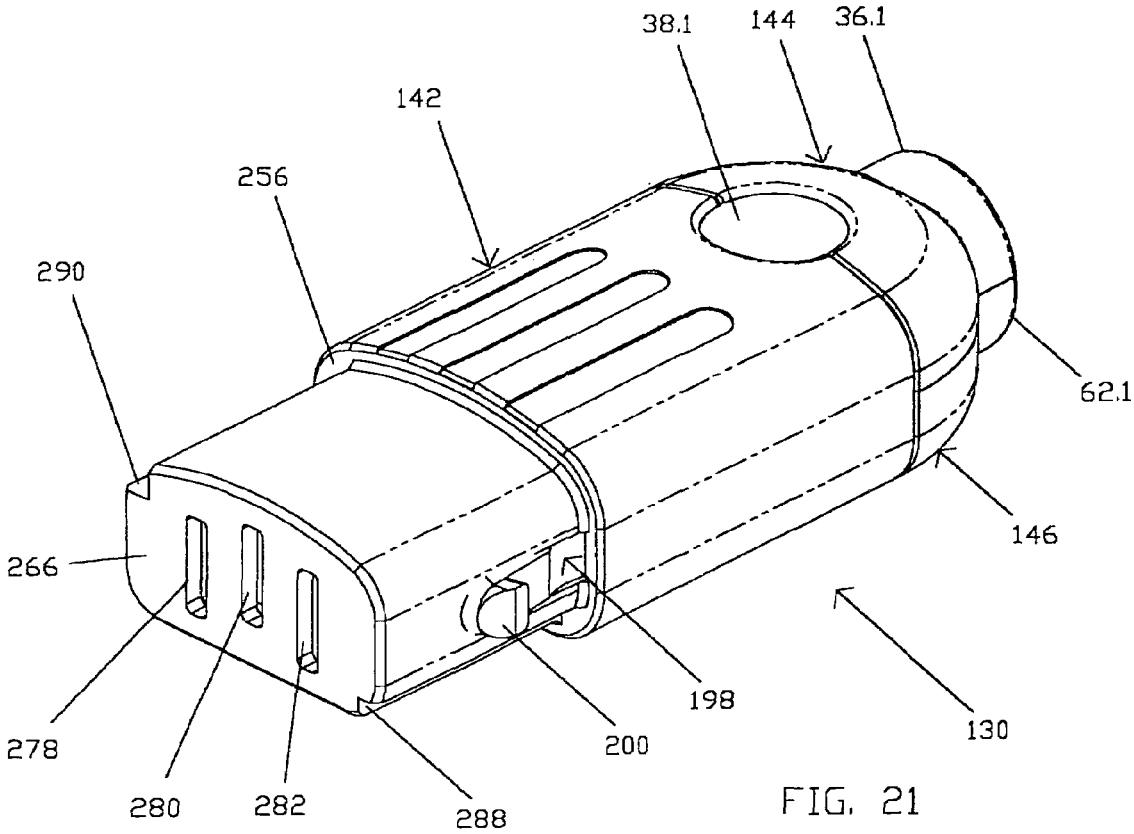
FIG. 21 is a pictorial view of an assembled installation socket.

Referring now to FIGS. 13 and 16, the socket contacts 134, 136, 138 are substantially rectangular in shape and are manufactured from brass, or other suitable electrically conducting material. The material is bent to form two substantially vertical walls 220 and 222 which are joined by a part cylindrical section 224. The socket contacts 134, 136, 138 also have rearward extensions (FIG. 16). The side walls 220, 222 and the section 224 form a vertical channel 226 (see FIG. 13). Each channel 226 is open along one edge, bounded along its other edge by the arcuate section 224 and on the sides by the walls 220, 222.

Recesses 228 and 230 are provided in the upper and lower edges 232 and 234 respectively of the rearward extension 225 of the side wall 222 and assist in locating and securing the socket contacts 134, 136, 138 in the upper and lower casing parts 144 and 146.

A rectangular elongate portion 236 extends rearwardly from the extension 225 and is bent through right-angles to form two parallel side walls 238. The side walls 238 are perpendicular to the remainder of the elongate portion 236. The channel-like configuration of the elongate portion 236 can best be seen in FIG. 13.

Three protrusions 163 (FIG. 13) protrude forwardly from the front wall 165 of the part 144. There are gaps 166 between the protrusions 163.

On assembly, the socket contacts 134, 136, 138 are inserted into the slots 191, 192, 193 in the lower casing part 146 such that the front wall 54.1 of the lower casing part 146 is within the recess 230 (FIG. 16) of each socket contacts 134, 136, 138. This locates the socket contacts 134, 136, 138 with respect to the lower casing part 146. Thereafter, the upper casing part 144 is placed on the lower casing part 146. The spacers 190 fit into grooves (not shown) equivalent to the grooves 46 (FIG. 3) which are provided on the underside of the upper casing part 144.

Referring now to FIGS. 17 to 20, the sleeve 142 comprises a front section 252 and a rear section 254. The sleeve 142 is stepped to provide a shoulder 256 which extends around the circumference of the sleeve 142.

The sleeve 142 is open at its rear end and its top 268, bottom 270 and side walls 272, 274 bound a cavity for receiving the casing 132. The sleeve 142 has a front wall 266 with three vertical slots 278, 280, 282 for receiving the plug pins 18, 20, 22.

The front section 252 has a side wall 262 which is stepped along its lower edge to provide a longitudinal groove 288 which extends from the front of the section 252 to the shoulder 256. Similarly, the side wall 264 is stepped along its upper edge to provide a longitudinal groove 290 which extends from the front of the section 252 to the shoulder 256. On assembly of the installation plug 10 to the installation socket 130, the grooves 288, 290 cooperate with the ribs 128 (FIG. 8) of the installation plug's sleeve 24.

A longitudinally extending slot 292 is provided in the side wall 262. The slot 292 receives the barbed portion 200 of the elongate protrusion 198 (see FIG. 21).

Figure 22:
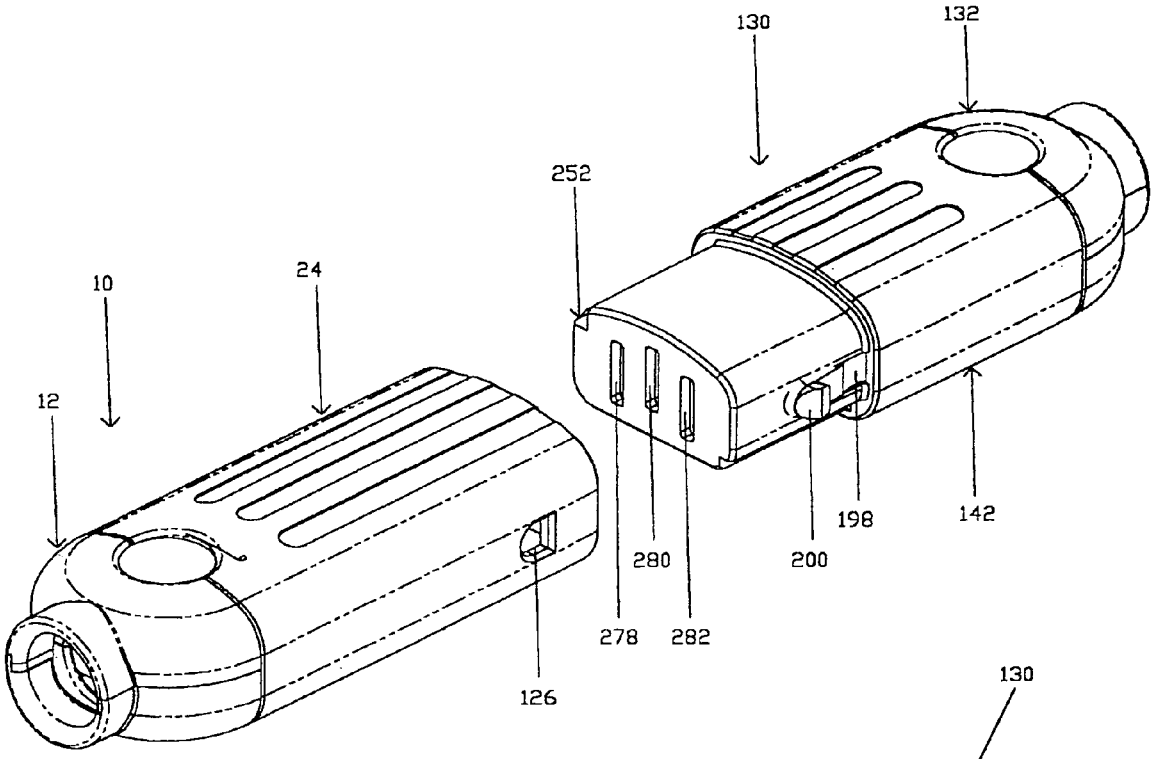
FIG. 22 is a pictorial view of an installation plug and installation socket prior to connection to one another.
Figure 23:
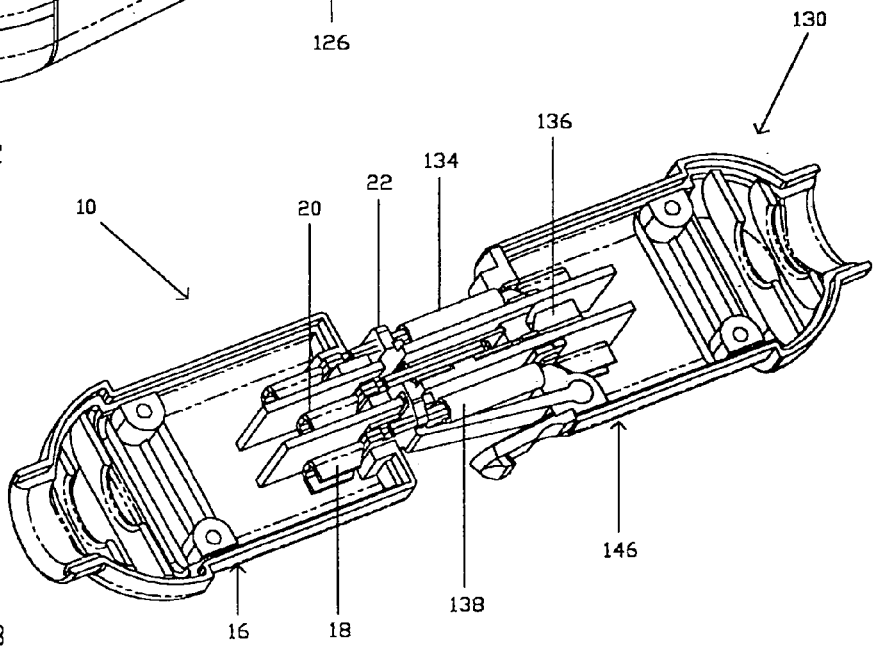
FIG. 23 is a pictorial view of the lower casing part of an installation plug and the lower casing part of an installation socket which are connected to each other to form an installation coupler.

Referring to FIG. 22, the assembled installation plug 10 is connected to the assembled installation socket 130 by inserting the front section 252 of the sleeve 142 into the cavity 114 (FIG. 9) of the sleeve 24 of the installation plug 10 such that the plug pins 18, 20, 22 come into register with the slots 278, 280, 282 provided in the front wall 266 of the sleeve 142. The longitudinal ribs 128 in the sleeve 24 enter the longitudinal grooves 288 and 290 of sleeve 142.

The front wall 204 (FIG. 13) of the shutter 140 extends across the front entrances of the socket contacts 134, 136, 138 between the wall 266 and the socket contacts 134, 136, 138. The slots 210 and 212 are slightly out of alignment with the slots 280 and 282.

When the installation plug 10 is inserted into the installation socket 130, the pins 18, 20 and 22 enter the slots 282, 280 and 278 respectively. On contact between the earth pin 20 and the chamfer of the slot 210 of the front wall 204 of the shutter 140, the front wall 204 is displaced. This enables the live and neutral pins 18, 22 to enter the respective socket contacts 138, 134.

Further movement of the installation plug 10 towards the installation socket 130 forces the main portion 81 (FIG. 7) of each pin 18, 20, 22 into the channel 226 (FIG. 13) of its respective socket contacts 134, 136, 138. The chamfers 80 of each pin 18, 20, 22 assist in forcing each pin 18, 20, 22 into each channel 236. Furthermore, movement of the installation plug 10 and installation socket 130 towards each other results in the side wall 112 of the sleeve 24 depressing the barbed portion 200 of the elongate protrusion 198.

The installation plug 10 is finally secured to the installation socket 130 when the sleeve 24 abuts the shoulder 256 (FIG. 17) of the sleeve 142 and when the barbed portion 200 extends through the slot 126 of the sleeve 24. The barbed portion 200 ensures that the installation plug 10 and installation socket 130 cannot be disconnected by merely pulling them apart. Prior to disconnection, the barbed portion 200 must be pressed in using a tool.

Figure 24:
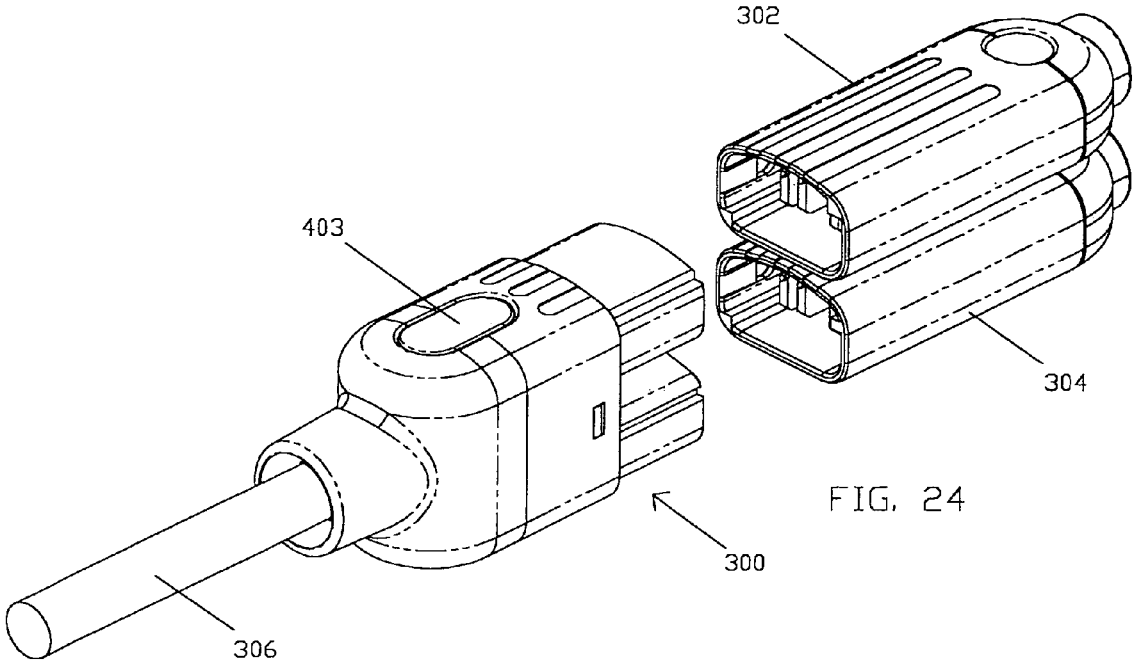
FIG. 24 illustrates a double installation socket and two installation plugs.
Figure 25:
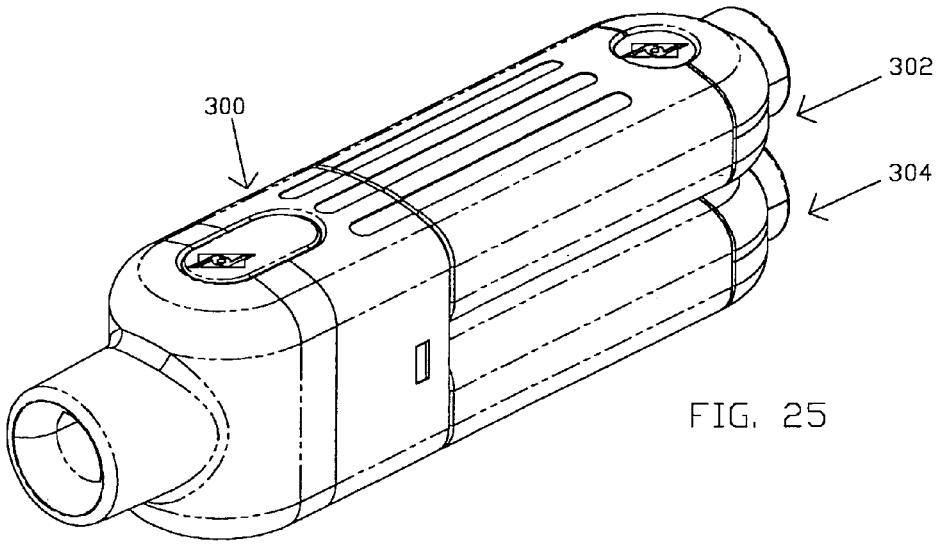
FIG. 25 illustrates the two installation plugs plugged into the installation socket.

The double installation socket 300 of FIG. 24 is used in conjunction with two installation plugs 302 and 304. Where applicable, parts which correspond with parts described above are designated with the same reference numerals with the addition of the suffix .3 (FIGS. 27 to 30).

Figure 26:
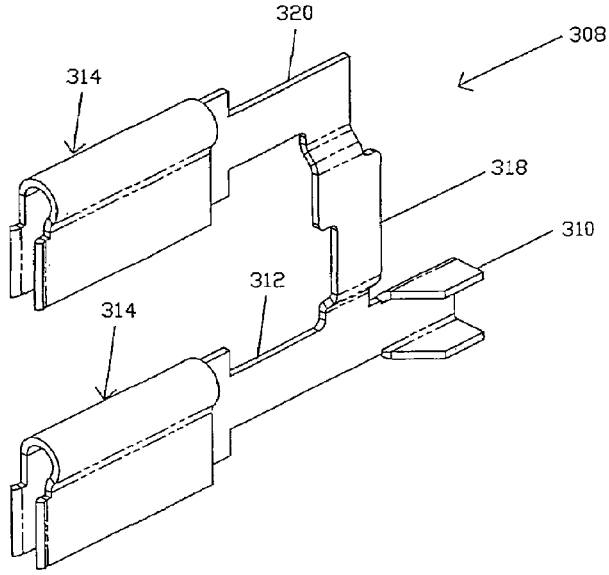
FIG. 26 is a pictorial view of an interlinking contact structure.

The cable designated 306 (FIG. 24) has its three cores attached to three of the socket contact structures 308 illustrated in FIG. 26. Each of these structures 308 comprises a crimping section 310 which can be crimped on one of the cores. A straight flat bar 312 extends from the section 310 to a socket contact 314. The socket contact 314 is of the same construction as the socket contacts 134, 136, 138 shown in FIG. 16.

A cranked link 318 extends upwardly from the bar 312 to one end of a further straight bar 320 which has a socket contact 314 at the other end thereof.

It will be understood from this description that the two sets of socket contacts 314 of the double installation socket 300 of FIG. 24 receive power from a single cable 306.

Figure 27:
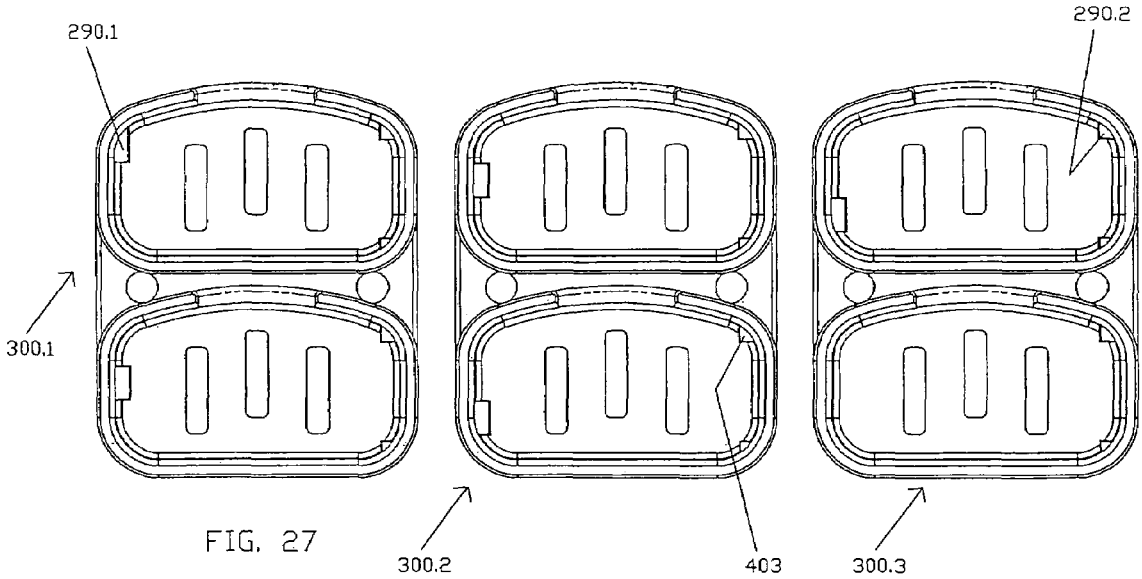
FIG. 27 is a front view of three double installation sockets for what is known as a "quad" system.
Figure 28:
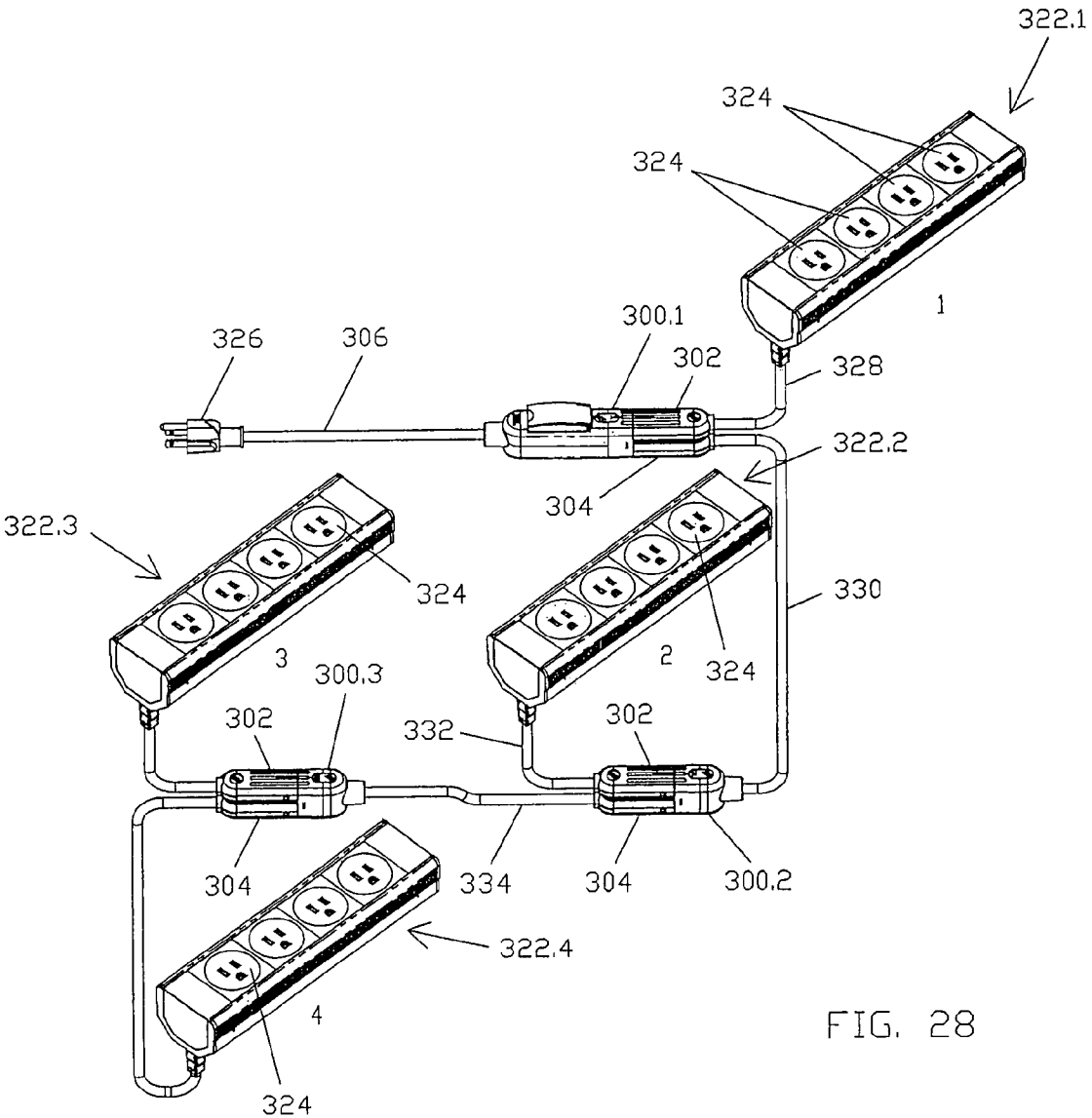
FIG. 28 is a diagrammatic representation of a power supply installation of the "quad" type.

FIG. 28 illustrates a power supply installation wherein three double female installation sockets as shown in FIG. 27 are required to connect four socket boxes 322 each having four plug sockets 324 therein. The cable 306 is connected to the mains supply via a plug 326. A first installation socket 300.1 connects to the upper installation plug 302, which in turn is connected by a power lead 328 to a first socket box 322.1 having four sockets 324. The lower installation plug 304 has a power lead 330 connected thereto and this has another double installation socket 300.2 at the other end thereof. The arrangement described in relation to the installation socket 300.1 is repeated and thus another socket box 322.2 is supplied with power through a top male installation plug 302 via a power lead 332. Similarly, the lower male installation plug 304 is connected via a power lead 334 to a further double female installation socket 300.3. This arrangement as described is repeated to connect the socket boxes 322.3 and 322.4. Disconnecting any male installation plug 302 does not interrupt the power supply to the downstream part of the circuit illustrated.

Figure 29:
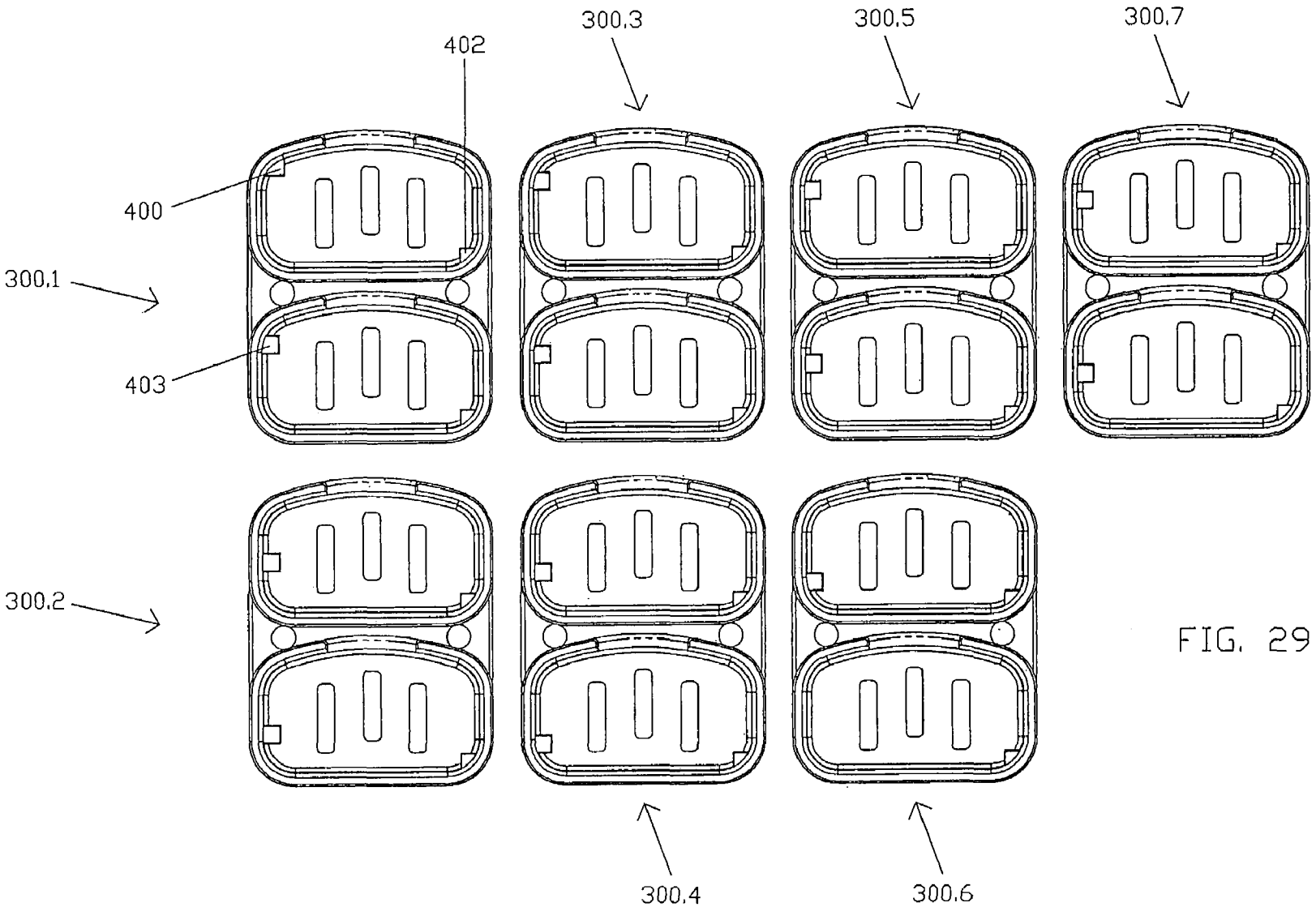
FIG. 29 illustrates seven double installation sockets for what is known as a "duplex" system.

In the event that each socket box 322 has two plug sockets 324 then the set of seven double female installation sockets shown in FIG. 29 can be used for this purpose. A power supply installation using this arrangement is illustrated in FIG. 30.

Figure 30:
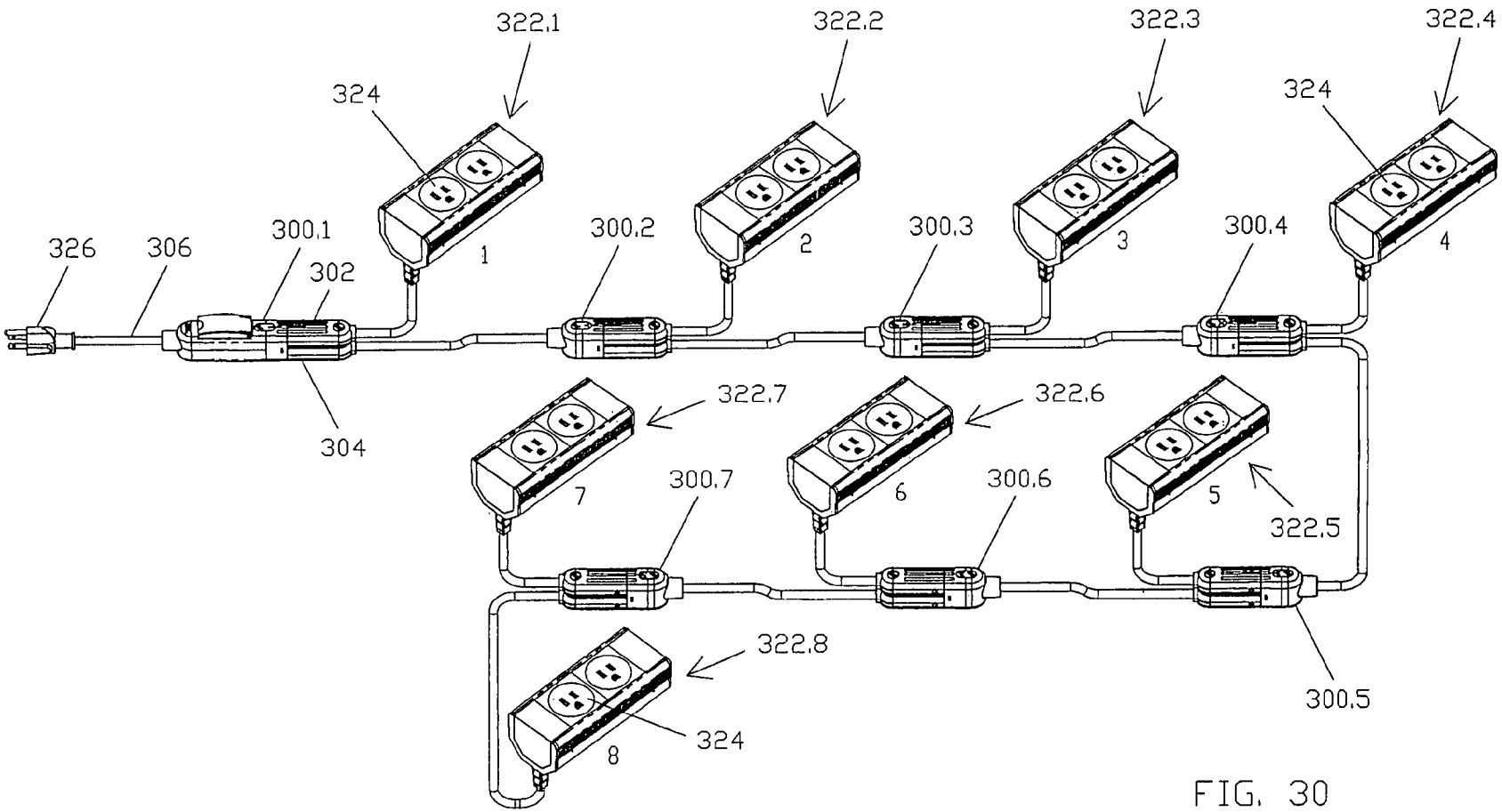
FIG. 30 is a diagrammatic representation of a power supply installation of the "duplex" type.

The third double female installation socket 300.3 in FIGS. 27 and 28 and the seventh double female installation socket 300.7 of FIGS. 29 and 30 are terminal installation sockets.

The patterns of grooves 290.1, 290.2 etc. in FIG. 27 correspond to the patterns of ribs 128 (FIG. 8) of the male installation plugs so that the male installation plugs and female installation sockets can only be connected togther in a predetermined sequence. As will be seen from FIGS. 28 and 30, the last pair of installation plugs (referenced 302 and 304 in FIG. 28) are both connected to socket boxes. The socket boxes are designated 322.3 and 322.4. One of the last pair of installation plugs is "universal" in that it can be plugged into all of the lower female installation sockets thereby to enable the series to be terminated at any one of the female installation sockets.

To facilitate connection of the male installation plugs and female installation sockets in the predetermined correct sequence they can be numbered and also colour coded. The male installation plugs can be moulded in plastics material of different colours. The double female installation sockets cannot be moulded in two colours. To achieve colour coding, buttons 403 (FIGS. 24 and 32) of appropriate colour are pressed into recesses provided therefor in both the upper and lower faces of the double female installation socket.

Applicants have found that if sufficient force is exerted, it is possible to insert some of the male installation plugs 304 into some of the upper sockets of the double female installation sockets 300.1, 300.2 etc. Not all the plugs 304 can be forced into all the upper sockets as some of the ribs and grooves are too incompatible. However, some combinations of plugs and upper sockets inevitably exist where exertion of an excessive force overrides the rib and groove combination.

If this is done, a forked layout can be obtained with each branch of the fork comprising a series of male plugs, female sockets and boxes 324 etc. Such a layout falls outside the allowable specification for this type of installation.

Figure 31:
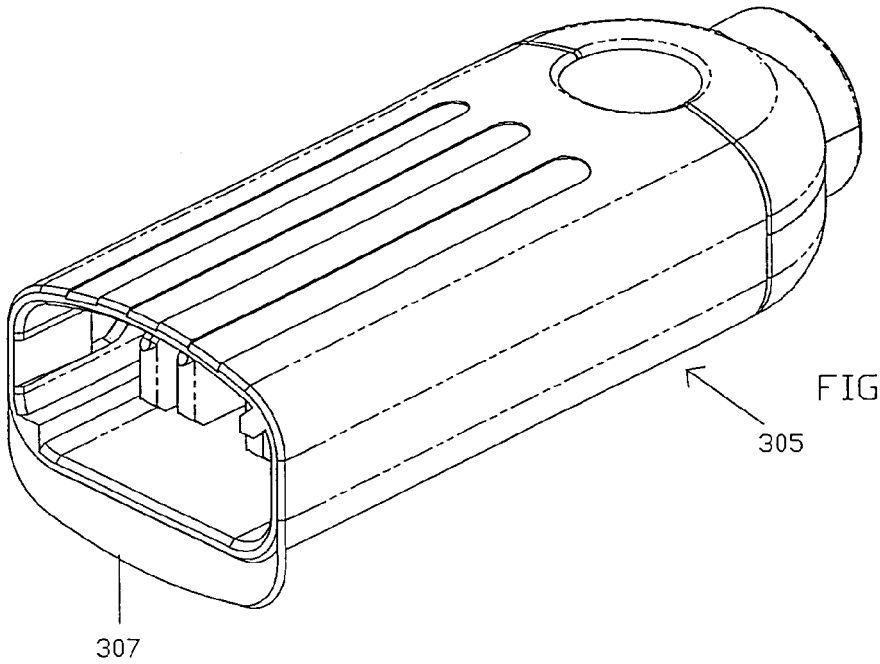
FIG. 31 illustrates an alternative form of installation plug.
Figure 32:
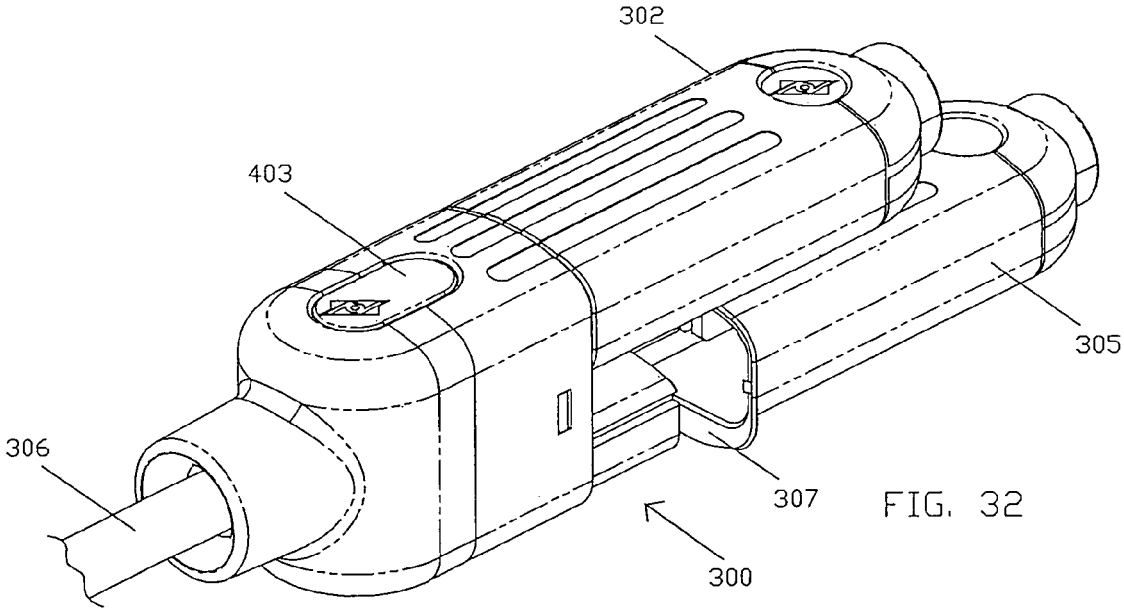
FIG. 32 illustrates the installation plug of FIG. 31 cooperating with an installation socket.

The structure shown in FIGS. 31 and 32 prevents a configuration of this type being created. In these Figures, there is shown a further form of installation plug which is designated 305. The plug 305 is identical to the plugs 302 and 304, except that the plug 305 has a downwardly protruding stop in the form of a flange 307 located at the front edge of the sleeve which forms part of the male installation plug as described above. As shown in FIG. 32, the flange 307 ensures that the plug 305 cannot be incorrectly connected to the installation socket 300. When the plug 305 is presented to the lower female socket, full interconnection is possible. However, if the plug 305 is presented to the upper female socket, the flange 307 makes contact with the lower female. This prevents the plug 305 and upper socket 300 from interengaging, thus preventing incorrect connection of the plug 305 to the socket 300.

Since the plugs 305 cannot be inserted into the upper females because of the obstructing flange 307, and the order in which the socket boxes 322.1, 322.2 etc. are connected to the circuit is not of significance, all the upper plugs 302 can be identical. This reduces the number of unique components required to achieve the installations of FIGS. 28 and 30.

If male installation plugs of the form shown in FIG. 31 are used in place of the plugs 304 in FIG. 28 then it becomes impossible to plug any one of the male connectors 305 into the top female installation socket. Only male plugs 302 which are devoid of the flange 307 can be plugged into the top female socket.

This has a number of practical ramifications. The first is that it becomes unnecessary for the upper female sockets and for the male plugs which are connected to the socket boxes 322.1 to be formed with unique combinations of ribs and grooves. The male installation plugs connected to the socket boxes can be identical to one another and not colour coded, and the upper female installation sockets can all be identical to one another. Thus any male installation plug 302 can be plugged into any upper female installation socket.

The male installation plugs which connect to the lower female installation sockets, and these sockets are, however, provided with unique combinations of ribs and grooves so that connection in one order only is possible. One of the male installation plugs which includes a flange 307, is universal in that it will fit any one of the double female installation plugs to terminate the sequence after a requisite number of socket boxes have obtain plugged into the double female sockets.

With the arrangement it becomes impossible to exceed the number of socket boxes for which the system is designated. Even if two complete systems are purchased any attempt to combine the systems and obtain more than the permitted number of socket boxes will fail because of the restrictions that the described system places on the way in which compatibility can be connected.

The invention claimed is:

1. An installation coupler for connecting a first cable to a second cable while providing a free set of plug pin socket contacts, said first cable having a double female installation socket attached thereto and said second cable having a male installation plug attached thereto, said male installation plug comprising a set of male plug pins which include means for enabling the cores of said second cable to be attached thereto and said double female installation socket comprising first and second sets of plug pin socket contacts said sets of contacts being connected to one another, there being means for attaching the cores of said first cable to the two sets of contacts, said pins of the male installation plug and corresponding contacts in each of said sets of contacts in the double female installation plug having a configuration that allows the pins to be in register with the contacts of one of the sets of contacts, only when the male installation plug has a predetermined orientation relative to the set of contacts, wherein the male installation plug includes a protruding stop that at least partly obstructs the first set of contacts and prevents the male installation plug from connecting to the second set of contacts and that is clear of the second set of contacts and does not prevent the male installation plug from connecting to the first set of contacts.

2. An installation coupler as claimed in claim 1, wherein said male installation plug includes an elongate casing having a bore at one end through which the second cable enters the installation plug, said plug pins being at the other end of the casing of the male installation plug, said stop of said male installation plug being a flange which protrudes outwardly from said casing, adjacent said other end.

3. An installation coupler as claimed in claim 1, wherein said double female installation socket includes a casing and said contacts are in said casing, the two sets of contacts being disposed in a parallel configuration.

4. An installation coupler as claimed in claim 3, wherein a plug pin entrance is defined in the casing in line with each contact and the female installation socket includes a shutter within the casing, said shutter being displaceable between an operative position in which it extends, at least in part, across at least some of said entrances, and an inoperative position in which openings in the shutter and openings in walling of the casing are in register for permitting the male plug pins of said male installation plug to pass through said openings and enter the socket contacts, said opening in the shutter being partially aligned with one of the openings in the walling when in the operative position, whereby an entering male plug pin can displace the shutter to its inoperative position so that a set of male plug pins can enter the socket contacts.

5. An installation for supplying power to at least two electrical devices, said installation including a main plug for connecting the installation to a source of electrical power, a double female installation socket, and a first cable connecting said main plug to said double female installation socket, the double female installation socket comprising first and second sets of plug pin socket contacts, said set of contacts being connected to one another and there being means for attaching the cores of said first cable to said two sets of contacts, said installation further including a second cable having a male installation plug attached thereto, said male installation plug comprising a set of male plug pins which include means for enabling the cores of said second cable to be attached thereto, said pins of the male installation plug and corresponding contacts in each of said sets of contacts in the double female installation plug having a configuration that allows the pins to be in register with the contacts of one of the sets of contacts, only when the male installation plug has a predetermined orientation relative to the set of contacts, wherein the male installation plug includes a protruding stop that at least partly obstructs the first set of contacts and prevents the male installation plug from connecting to the second set of contacts and that is clear of the second set of contacts and does not prevent the male installation plug from connecting to the first set of contacts, the second set of contacts being connectable to a first electrical device and the second cable being connectable to at least one further electrical device.

6. An installation as claimed in claim 5, wherein said male installation plug includes an elongate casing having a bore at one end through which the second cable enters the installation plug, said plug pins being at the other end of the casing of the male installation plug, said stop of said male installation plug being a flange which protrudes outwardly from said casing, adjacent said other end.

7. An installation as claimed in claim 5, wherein said double female installation socket includes a casing and said contacts are in said casing, the two sets of contacts being disposed in a parallel configuration.

8. An installation coupler as claimed in claim 7, wherein a plug pin entrance is defined in the casing in line with each contact and the female installation socket includes a shutter within the casing, said shutter being displaceable between an operative position in which it extends, at least in part, across at least some of said entrances, and an inoperative position in which openings in the shutter and openings in walling of the casing are in register for permitting the male plug pins of said male installation plug to pass through said openings and enter the socket contacts, said opening in the shutter being partially aligned with one of the openings in the walling when in the operative position, whereby an entering male plug pin can displace the shutter to its inoperative position so that a set of male plug pins can enter the socket contacts.

9. An installation coupler as claimed in claim 5, wherein a second double female installation socket is connected to the end of the second cable that is remote from the male installation plug.

* * * * *